US009207550B2

(12) United States Patent
Okuda et al.

(10) Patent No.: US 9,207,550 B2
(45) Date of Patent: Dec. 8, 2015

(54) PROCESS FOR PRODUCING ELECTROPHOTOGRAPHIC PHOTOSENSITIVE MEMBER

(71) Applicant: CANON KABUSHIKI KAISHA, Tokyo (JP)

(72) Inventors: Atsushi Okuda, Yokohama (JP); Harunobu Ogaki, Suntou-gun (JP); Kunihiko Sekido, Suntou-gun (KP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/304,172

(22) Filed: Jun. 13, 2014

(65) Prior Publication Data

US 2014/0377701 A1 Dec. 25, 2014

(30) Foreign Application Priority Data

Jun. 19, 2013 (JP) ..... 2013-128288
Jun. 10, 2014 (JP) ..... 2014-119359

(51) Int. Cl.
*G03G 5/087* (2006.01)
*G03G 5/14* (2006.01)
*G03G 5/05* (2006.01)

(52) U.S. Cl.
CPC ..... *G03G 5/14* (2013.01); *G03G 5/0525* (2013.01); *G03G 5/142* (2013.01)

(58) Field of Classification Search
CPC ..... G03G 5/10; G03G 5/0525; G03G 5/102
See application file for complete search history.

(56) References Cited

U.S. PATENT DOCUMENTS 5,795,690 A * 8/1998 Takegawa et al. ..... 430/58.25
6,225,014 B1 5/2001 Patterson et al.
2013/0244172 A1 9/2013 Sekiya et al.

FOREIGN PATENT DOCUMENTS

JP 2007-79555 A 3/2007
JP 2011-128213 A 6/2011
JP 2012-128397 A 7/2012
WO 2012/070472 A1 5/2012
WO 2012/118230 A1 9/2012

OTHER PUBLICATIONS

Okuda, et al., U.S. Appl. No. 14/353,463, filed Apr. 22, 2014.
Ogaki, et al., U.S. Appl. No. 14/295,989, filed Jun. 4, 2014.
Yamashita, et al. (eds.), "Crosslinking Agent Handbook", Taiseisha Ltd., 1981, pp. 536-605.
European Search Report dated Nov. 17, 2014 in European Application No. 14002091.8.

* cited by examiner

*Primary Examiner* — Hoa V Le
(74) *Attorney, Agent, or Firm* — Fitzpatrick, Cella, Harper and Scinto

(57) ABSTRACT

Provided is a process for producing an electrophotographic photosensitive member having high uniformity of the surface of its undercoat layer by which the usage of an organic solvent is reduced and the stability of an application liquid for an undercoat layer after its long-term storage is improved in the step of forming the undercoat layer. The process for producing an electrophotographic photosensitive member includes the steps of: preparing a solution containing a liquid whose solubility in water at 25° C. and 1 atmosphere is 3.0 mass % or less and an electron transporting substance; preparing an emulsion by dispersing the solution in water; forming a coat of the emulsion on a support; and forming the undercoat layer by heating the coat.

11 Claims, 1 Drawing Sheet

PROCESS FOR PRODUCING ELECTROPHOTOGRAPHIC PHOTOSENSITIVE MEMBER

BACKGROUND OF THE INVENTION

1. Field of the Invention

The present invention relates to a process for producing an electrophotographic photosensitive member.

2. Description of the Related Art

An electrophotographic photosensitive member containing an organic photoconductive substance (hereinafter referred to as "charge generating substance") is known as an electrophotographic photosensitive member to be mounted on an electrophotographic apparatus. At present, the above-mentioned electrophotographic photosensitive member has been a mainstream electrophotographic photosensitive member to be used in a process cartridge of an electrophotographic apparatus or in the electrophotographic apparatus, and has been put into large-scale production. Of such electrophotographic photosensitive members, a laminated electrophotographic photosensitive member improved in characteristics by separating functions needed for an electrophotographic photosensitive member into its respective layers has been frequently used. A construction obtained by laminating an undercoat layer, a charge generating layer, and a hole transporting layer in the stated order on a support has been adopted as a main construction of the laminated electrophotographic photosensitive member.

A method involving dissolving a functional material in an organic solvent to prepare an application solution (application liquid) and applying the solution onto the support has been generally employed as a method of producing the laminated electrophotographic photosensitive member. The reduction of the organic solvent in the step of forming a coat for each layer has been desired in recent years. Such a proposal as described below has been made in a layer in which an electron transporting substance has been dispersed as a proposal for the reduction of the organic solvent for the undercoat layer of the laminated electrophotographic photosensitive member.

Japanese Patent Application Laid-Open No. 2012-128397 proposes a method involving: producing a water dispersion liquid containing polyolefin resin particles and particles each containing an electron transporting substance; forming the coat of the dispersion liquid on a support; and forming an undercoat layer by heating the coat to melt the polyolefin resin particles. In Japanese Patent Application Laid-Open No. 2012-128397, the undercoat layer in which the particles each containing the electron transporting substance have been dispersed is formed.

However, as a result of the studies made by the inventors of the present invention, the method disclosed in Japanese Patent Application Laid-Open No. 2012-128397 is a method of forming an undercoat layer in which the electron transporting substance has been dispersed in a state of particles each containing the electron transporting substance, and hence stability of the water dispersion liquid during its long-term storage and uniformity of a surface of the undercoat layer are liable to reduce in some cases. Therefore, a production method by which the organic solvent is reduced and the stability of the application liquid for an undercoat layer and the uniformity of the surface of the undercoat layer are improved in formation of the undercoat layer has been desired.

SUMMARY OF THE INVENTION

An object of the present invention is to provide a process for producing an electrophotographic photosensitive member, in particular, a process for producing an electrophotographic photosensitive member having high uniformity of the surface of its undercoat layer by which the usage of an organic solvent is reduced and the stability of an application liquid for an undercoat layer after its long-term storage is improved in the step of forming the undercoat layer.

The present invention relates to a process for producing an electrophotographic photosensitive member including a support, an undercoat layer formed on the support, a charge generating layer formed on the undercoat layer, and a hole transporting layer formed on the charge generating layer, the process including the steps of: preparing a solution containing: a liquid whose solubility in water at 25° C. and 1 atmosphere is 3.0 mass % or less and an electron transporting substance; preparing an emulsion by dispersing the solution in water, forming a coat of the emulsion on the support; and forming the undercoat layer by heating the coat.

According to one embodiment of the present invention, it is possible to provide the electrophotographic photosensitive member having high uniformity of the surface of its undercoat layer by the usage of an organic solvent is reduced and the stability of an application liquid for an undercoat layer (emulsion) after its long-term storage is improved.

Further features of the present invention will become apparent from the following description of exemplary embodiments with reference to the attached drawings.

DESCRIPTION OF THE EMBODIMENTS

Figure 1:
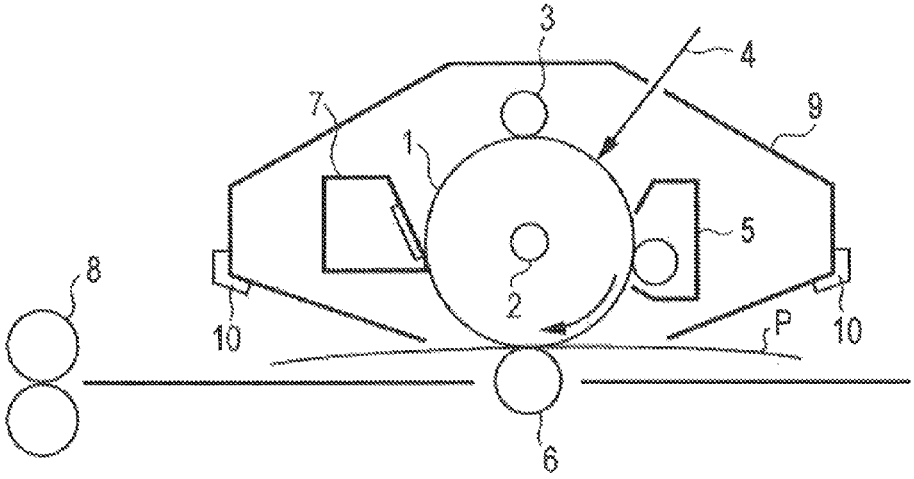
FIG. 1 is a view illustrating an example of the schematic construction of an electrophotographic apparatus including a process cartridge including an electrophotographic photosensitive member.

Preferred embodiments of the present invention will now be described in detail in accordance with the accompanying drawings.

A process for producing an electrophotographic photosensitive member of the present invention includes the following steps: as a first step, the step of preparing a solution containing a liquid whose solubility in water at 25° C. and 1 atmosphere is 3.0 mass % or less and an electron transporting substance and the step of preparing an emulsion by dispersing the solution in water. The process further includes the steps of: forming the coat of the emulsion on a support; and forming an undercoat layer by heating the coat.

A liquid whose solubility in water at 25° C. and 1 atmosphere is 5.0 mass % or more is preferably further incorporated into the solution from the viewpoint of an improvement in stability of an application liquid for an undercoat layer (emulsion).

The inventors of the present invention have assumed the reason why the usage of an organic solvent is reduced and the stability of the application liquid for an undercoat layer is improved in the process for producing an electrophotographic photosensitive member including the step of forming the undercoat layer of the present invention to be as described below.

In the present invention, the application liquid for an undercoat layer in which the usage of an organic solvent has been reduced can be provided by preparing the emulsion obtained by dispersing, in water, the solution obtained by dissolving at least the electron transporting substance in the liquid whose solubility in water at 25° C. and 1 atmosphere is 3.0 mass % or less (hydrophobic solvent). The emulsion of the present invention is in a state where oil droplets (also referred to as "emulsion particles") are dispersed in water because the solution is dispersed in water to be emulsified. In the production process of the present invention, a water-insoluble electron transporting substance and undercoat layer constituting component can be used as they are because the electron transporting substance and the undercoat layer constituting component are dissolved in the hydrophobic organic solvent before the emulsification. In general, an electron transporting substance is insoluble in water, or even when the substance dissolves in water, its concentration is low. In addition, its electrical characteristics are insufficient in many cases. Accordingly, it is difficult to use the substance in an aqueous application liquid, and the stability of the application liquid for an undercoat layer and the uniformity of the surface of the undercoat layer may be insufficient. On the other hand, in the production process of the present invention, the stability of the application liquid for an undercoat layer and the uniformity of the surface of the undercoat layer can be improved probably because the emulsion is prepared.

In addition, in the present invention, both the hydrophobic solvent, and the liquid whose solubility in water at 25° C. and 1 atmosphere is 5.0 mass % or more (hydrophilic solvent) are preferably used as organic solvents because the stability of the emulsion additionally improves. When the emulsion is prepared by dispersing the solution, which is obtained by dissolving at least the electron transporting substance through the use of the hydrophobic solvent and the hydrophilic solvent, in water, the following result is obtained: even when the emulsion is stored for a long time period, the stability of the emulsion is high, which is advantageous in terms of production. When the emulsion includes both the hydrophobic solvent and the hydrophilic solvent, the hydrophilic solvent in an oil droplet quickly migrates toward an aqueous phase in the emulsion, the oil droplet becomes additionally small, and the concentration of the electron transporting substance in the oil droplet increases. It is conceivable that as a result of the foregoing, the oil droplet is in a state close to a fine particle of solid matter, and the occurrence of the agglomeration of the oil droplets can be additionally suppressed as compared to the case where the emulsion is produced by using the hydrophobic solvent alone. It is also conceivable that the hydrophilic solvent has such amphipathic property as to dissolve both in water and oil, and hence the hydrophilic solvent serves like a surfactant in the oil droplet to suppress the agglomeration (coalescence) of the oil droplets. Probably as a result of the foregoing, the dispersed state in the emulsion can be maintained even after its long-term storage and the stability of the emulsion is improved.

Hereinafter, the process for producing an electrophotographic photosensitive member of the present invention and materials constituting the electrophotographic photosensitive member are described. The electrophotographic photosensitive member of the present invention includes a support, an undercoat layer formed on the support, a charge generating layer formed on the undercoat layer, and a hole transporting layer formed on the charge generating layer.

Figure 2:
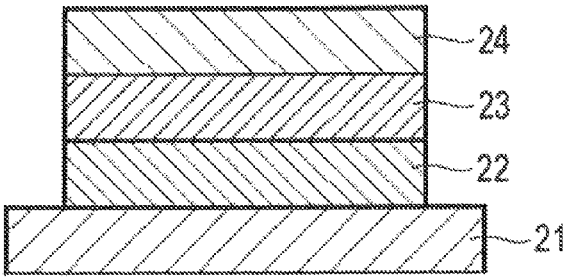
FIG. 2 is a view illustrating an example of the layer construction of an electrophotographic photosensitive member.

FIG. 2 is a view illustrating an example of the layer construction of the electrophotographic photosensitive member. In FIG. 2, the support is represented by reference numeral 21, the undercoat layer is represented by reference numeral 22, the charge generating layer is represented by reference numeral 23, and the hole transporting layer is represented by reference numeral 24.

Although a cylindrical electrophotographic photosensitive member obtained by forming a photosensitive layer (a charge generating layer or a hole transporting layer) on a cylindrical support has been widely used as a general electrophotographic photosensitive member, a shape such as a belt shape or a sheet shape can also be used.

(Undercoat Layer)

The electron transporting substance to be used for the undercoat layer is preferably an organic electron transporting substance. Examples of the electron transporting substance include an imide compound, a quinone compound, a benzimidazole compound, and a cyclopentadienylidene compound.

The imide compound is preferably a compound having a cyclic imide structure, and is preferably a compound represented by the following formula (1).

(1)

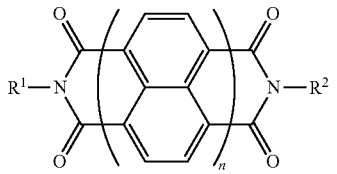

In the formula (1), $R^1$ and $R^2$ each independently represent a substituted or unsubstituted alkyl group, a substituted or unsubstituted phenyl group, or a substituted or unsubstituted pyridyl group. Examples of a substituent of the substituted alkyl group, a substituent of the substituted phenyl group, and a substituent of the substituted pyridyl group include an alkyl group, a haloalkyl group, a hydroxyalkyl group, a halogen atom, a hydroxy group, a carboxy group, a thiol group, an amino group, an alkoxy group, a cyano group, a nitro group, a phenyl group, and a phenylazenyl group. n represents the number of repetitions of a structure in parentheses, and represents 1 or 2.

The quinone compound is, for example, a compound having a para-quinoid structure or an ortho-quinoid structure. In addition, a compound having a structure in which aromatic rings are fused to each other is permitted, and a compound having a structure in which multiple quinoid structures are linked to each other is permitted. The quinone compound is preferably a compound represented by the following formula (2) or the following formula (3).

(2)

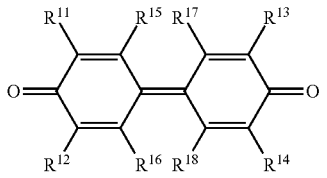

In the formula (2), $R^{11}$ to $R^{18}$ each independently represent a hydrogen atom, an alkyl group, or a divalent group represented by —CH═CH—CH═CH— formed by the bonding of adjacent groups represented by $R^{11}$ to $R^{18}$.

(3)

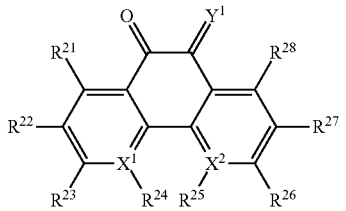

In the formula (3), $X^1$ and $X^2$ each independently represent a carbon atom or a nitrogen atom. $Y^1$ represents an oxygen atom or a dicyanomethylene group. $R^{21}$ to $R^{28}$ each independently represent a hydrogen atom, a halogen atom, a nitro group, a substituted or unsubstituted alkyl group, or a substituted or unsubstituted phenyl group. Examples of a substituent of the substituted alkyl group and a substituent of the substituted phenyl group include an alkyl group, a haloalkyl group, a halogen atom, a hydroxy group, a carboxy group, a thiol group, an amino group, a methoxy group, a nitro group, and a cyano group. In addition, when $X^1$ and $X^2$ each represent a nitrogen atom, none of $R^{24}$ and $R^{25}$ exists.

The benzimidazole compound is, for example, a compound having a benzimidazole ring structure. In addition, a compound having a structure in which aromatic rings are fused to each other is permitted. The benzimidazole compound is preferably a compound represented by the following formula (4), (5), or (6).

(4)

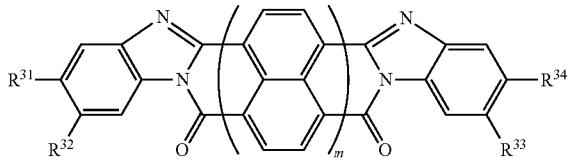

(5)

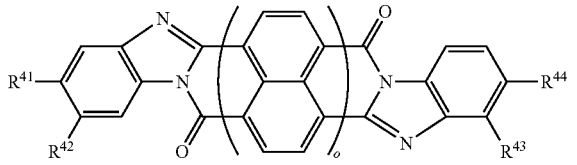

(6)

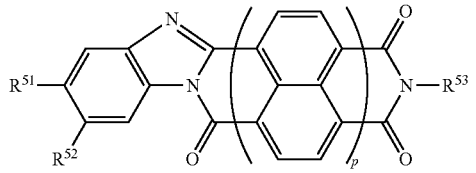

In the formula (4), $R^{31}$ to $R^{34}$ each independently represent a hydrogen atom, a halogen atom, or an alkyl group. m represents the number of repetitions of a structure in parentheses, and represents 1 or 2.

In the formula (5), $R^{41}$ to $R^{44}$ each independently represent a hydrogen atom, a halogen atom, or an alkyl group. o represents the number of repetitions of a structure in parentheses, and represents 1 or 2.

In the formula (6), $R^{51}$ and $R^{52}$ each independently represent a hydrogen atom, a halogen atom, a nitro group, or a substituted or unsubstituted alkyl group. $R^{53}$ represents a substituted or unsubstituted alkyl group, a substituted or unsubstituted phenyl group, or a substituted or unsubstituted naphthyl group. Examples of a substituent of the substituted alkyl group, a substituent of the substituted phenyl group, and a substituent of the substituted naphthyl group include an alkyl group, a hydroxyalkyl group, a haloalkyl group, a halogen atom, a hydroxy group, a carboxy group, a thiol group, an amino group, a methoxy group, a nitro group, and a cyano group. p represents the number of repetitions of a structure in parentheses, and represents 1 or 2.

The cyclopentadienylidene compound is, for example, a compound having a cyclopentadienylidene structure. In addition, a compound in which aromatic rings are fused to each other is permitted. The cyclopentadienylidene compound is preferably a compound represented by the following formula (7).

(7)

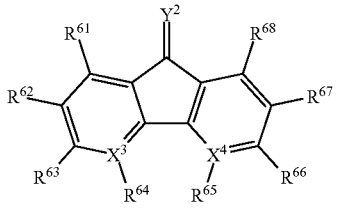

In the formula (7), $X^3$ and $X^4$ each independently represent a carbon atom or a nitrogen atom. $Y^2$ represents an oxygen atom, a dicyanomethylene group, or a substituted or unsubstituted phenylimino group. A substituent of the substituted phenylimino group is, for example, an alkyl group. $R^{61}$ to $R^{68}$ each independently represent a hydrogen atom, an alkoxycarbonyl group, or a nitro group. In addition, when $X^3$ and $X^4$ each represent a nitrogen atom, none of $R^{64}$ and $R^{65}$ exists.

The electron transporting substance in the present invention is preferably a compound exhibiting poor solubility in water because of a reason to be described later. As an index of the electron transporting substance exhibiting poor solubility in water, the electron transporting substance satisfying the following condition is defined as being poorly soluble: when the water and the electron transporting substance are mixed, the ratio of the electron transporting substance to dissolve in the water is 0.5 mass % or less.

When a crosslinking agent or a resin having a polymerizable functional group is used, the electron transporting substance is preferably an electron transporting substance having a polymerizable functional group. Examples of the polymerizable functional group include a hydroxy group, a thiol group, an amino group, a carboxyl group, and a methoxy group.

Next, the crosslinking agent is described. The crosslinking agent of the present invention is a compound having a group capable of reacting with the resin having a polymerizable functional group or the electron transporting substance having a polymerizable functional group. Specifically, for example, a compound described in "Crosslinking Agent Handbook" edited by Shinzo Yamashita and Tosuke Kaneko, and published by TAISEISHA LTD. (1981) can be used. For example, an isocyanate compound or an amine compound is preferred.

The isocyanate compound is preferably an isocyanate compound having 3 to 6 isocyanate groups or blocked isocyanate groups.

A blocked isocyanate group is a group having a structure represented by —NHCO$X^1$ (where X' represents a protective group). Although $X^1$ may represent any protective group as long as the group can be introduced into the isocyanate group, $X^1$ more preferably represents a group represented by any one of the following formulae (H1) to (H7).

(H1)

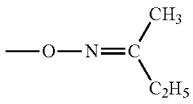

(H2)

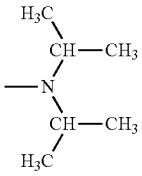

-continued
(H3)
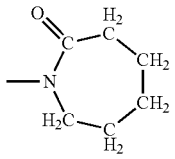
(H4)
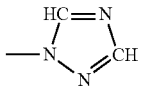
(H5)
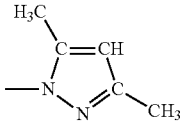
-continued
(H6)
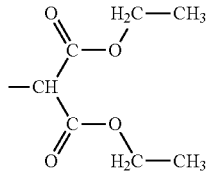
(H7)
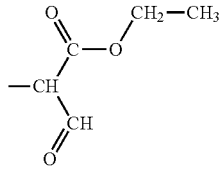
Specific examples of the isocyanate compound are shown below.
(B1)
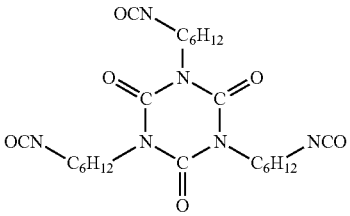
(B2)
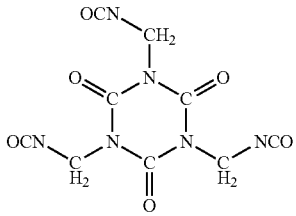
(B3)
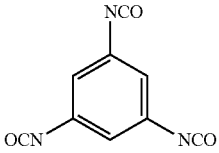
(B4)
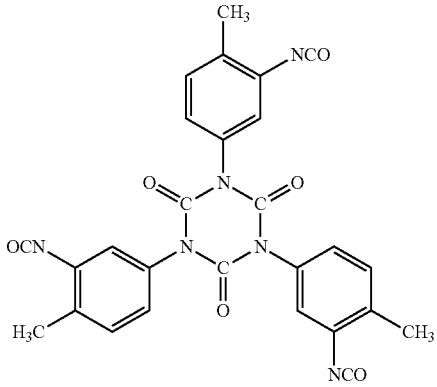
(B5)
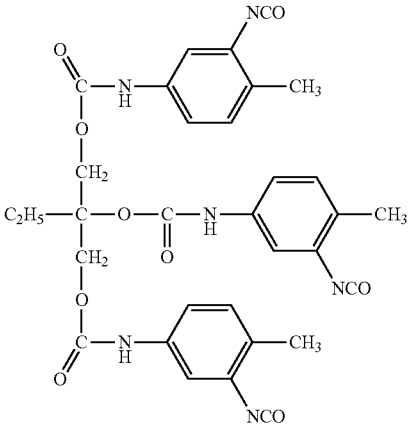
(B6)
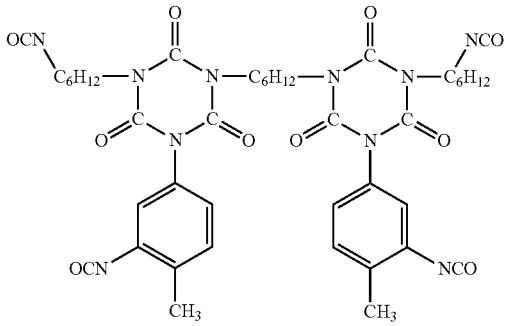

-continued
(B7)
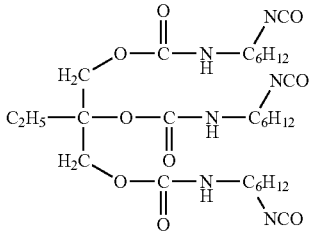
(B8)
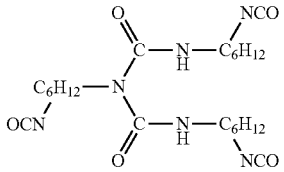
(B9)
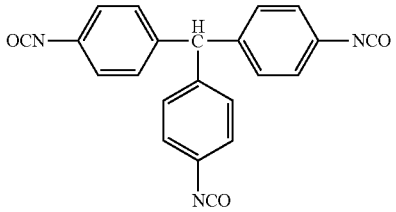
(B10)
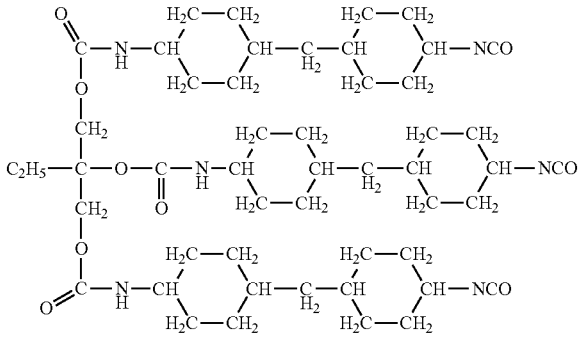
(B11)
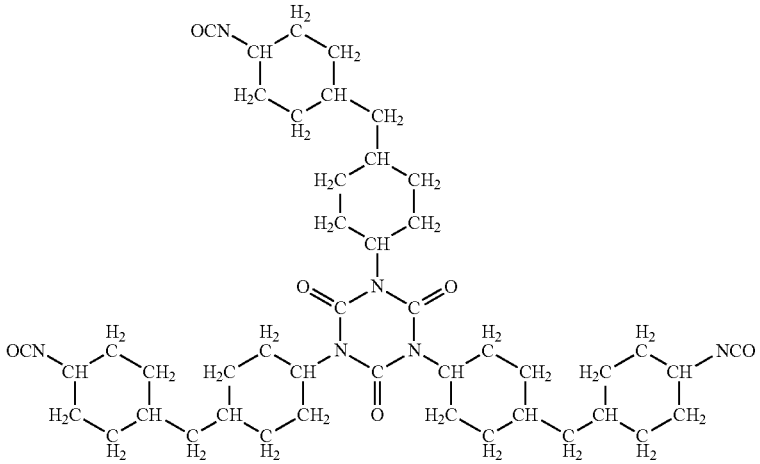
(B12)
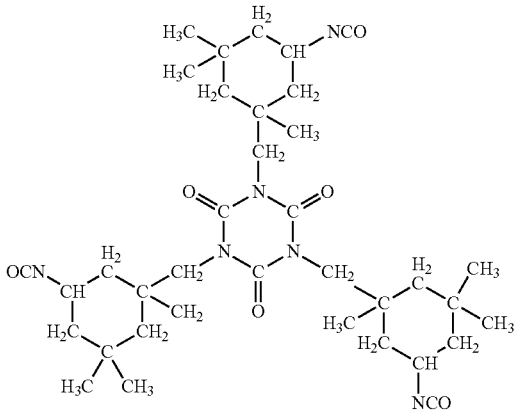
(B13)
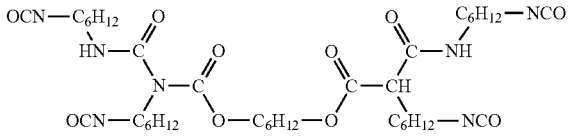

-continued
(B14)
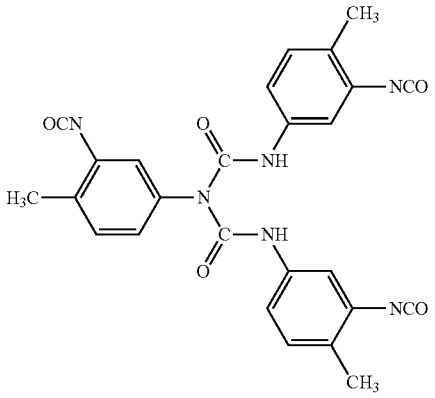
(B15)
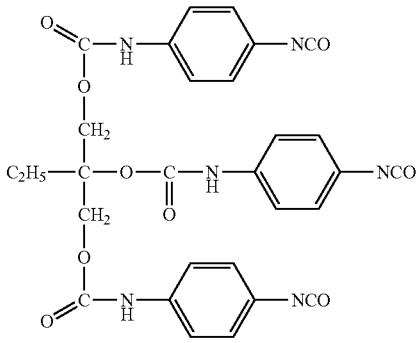
(B16)
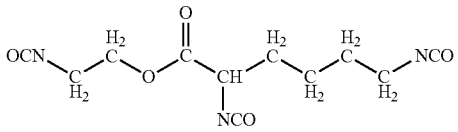
(B17)
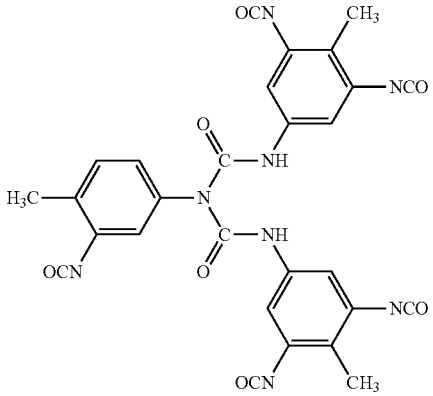
(B18)
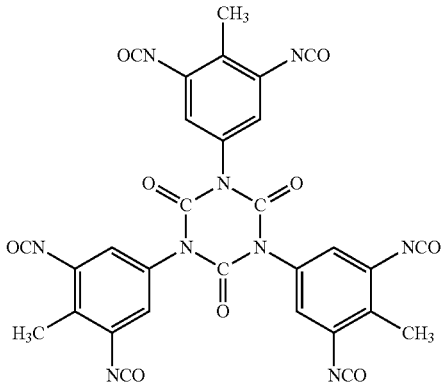
(B19)
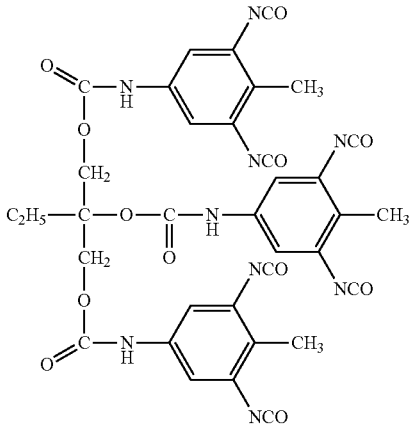
(B20)
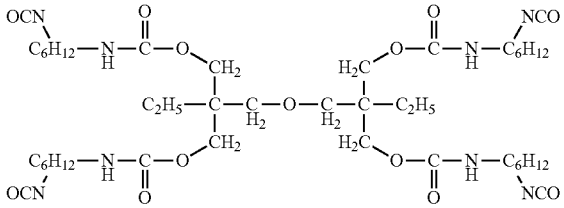
(B21)
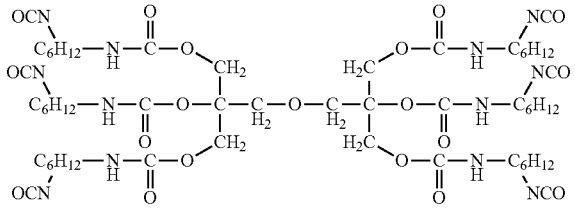

In addition, the amine compound is preferably a compound represented by any one of the following formulae (C1) to (C5), or an oligomer of the compound represented by any one of the following formulae (C1) to (C5).

(C1)

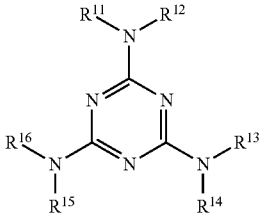

(C2)

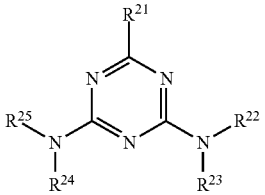

(C3)

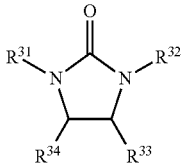

(C4)

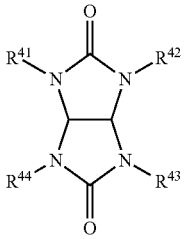

(C5)

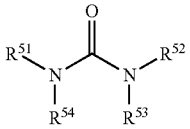

In the formulae (C1) to (C5), $R^{11}$ to $R^{16}$, $R^{22}$ to $R^{25}$, $R^{31}$ to $R^{34}$, $R^{41}$ to $R^{44}$, and $R^{51}$ to $R^{54}$ each independently represent a hydrogen atom, a hydroxy group, an acyl group, or a monovalent group represented by —$CH_2$—$OR^1$, and at least one of $R^{11}$ to $R^{16}$, at least one of $R^{22}$ to $R^{25}$, at least one of $R^{31}$ to $R^{34}$, at least one of $R^{41}$ to $R^{44}$, and at least one of $R^{51}$ to $R^{54}$ each represent a monovalent group represented by —$CH_2$—$OR^1$. $R^1$ represents a hydrogen atom, or an alkyl group having 1 or more and 10 or less carbon atoms. The alkyl group is preferably, for example, a methyl group, an ethyl group, a propyl group (an n-propyl group or an isopropyl group), or a butyl group (an n-butyl group, an isobutyl group, or a tert-butyl group) from the viewpoint of polymerizability. $R^{21}$ represents an aryl group, an alkyl group-substituted aryl group, a cycloalkyl group, or an alkyl group-substituted cycloalkyl group.

Specific examples of the compound represented by any one of the formulae (C1) to (C5) are shown below. In addition, the oligomer of the compound represented by any one of the formulae (C1) to (C5) may be incorporated. Two or more kinds of the oligomers and monomers can be used as a mixture.

Specific examples of the compound represented by any one of the formulae (C1) to (C5) are shown below. In formulae, Bu represents a butyl group.

(C1-1)

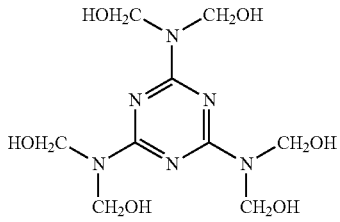

(C1-2)

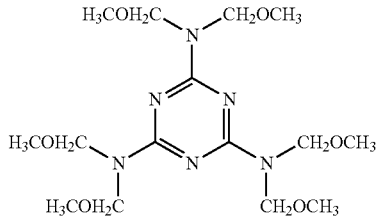

(C1-3)

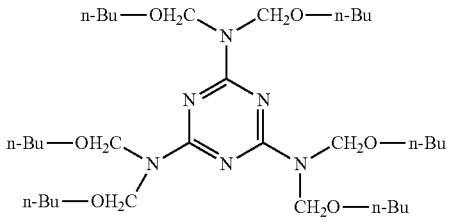

(C1-4)

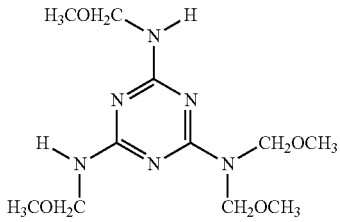

(C1-5)

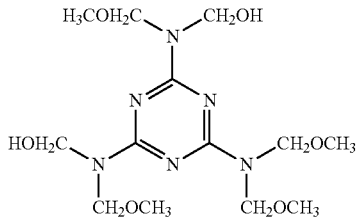

(C1-6)

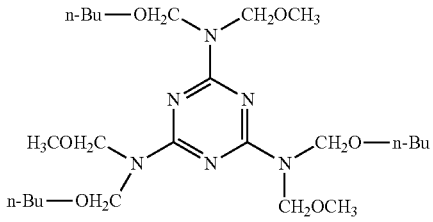

-continued
(C1-7)
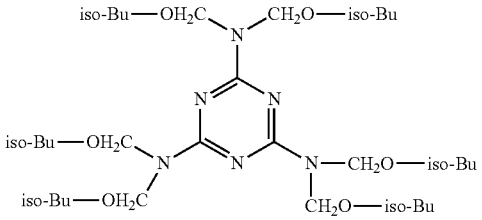
(C1-8)
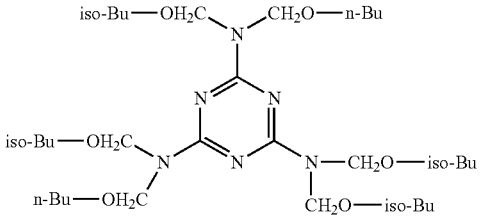
(C1-9)
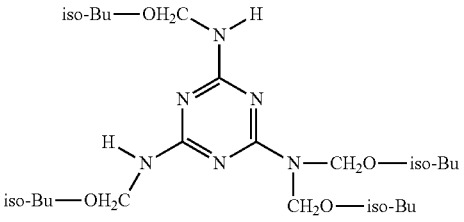
(C1-10)
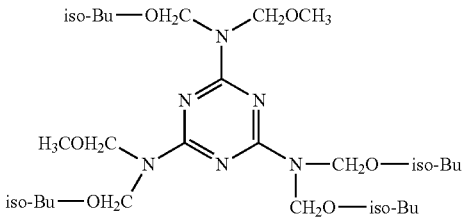
(C1-11)
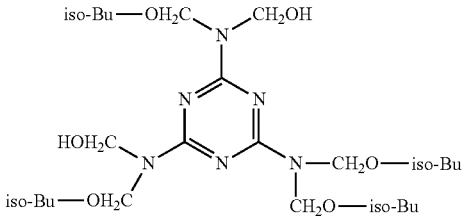
(C1-12)
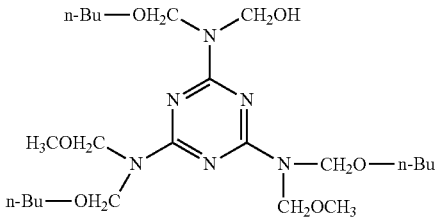
-continued
(C2-1)
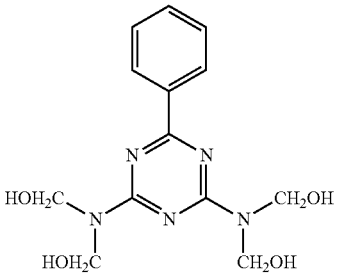
(C2-2)
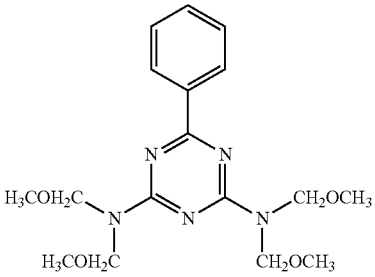
(C2-3)
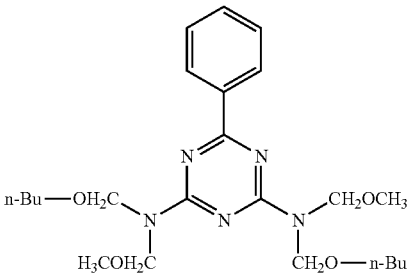
(C2-4)
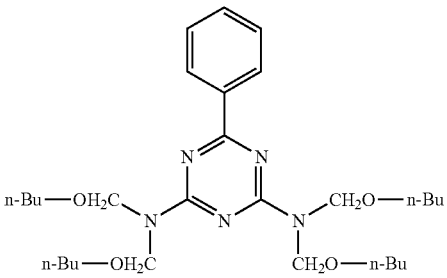
(C2-5)
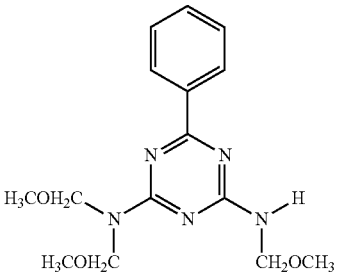

-continued
(C2-7)
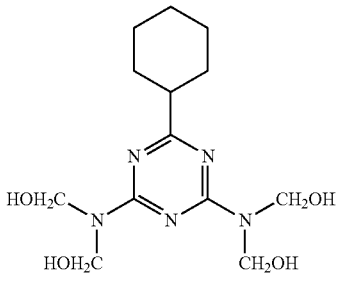
(C2-8)
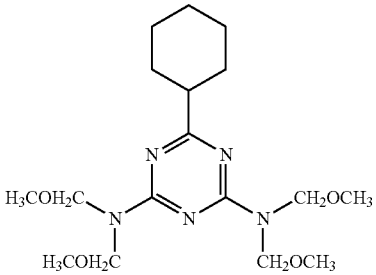
(C2-9)
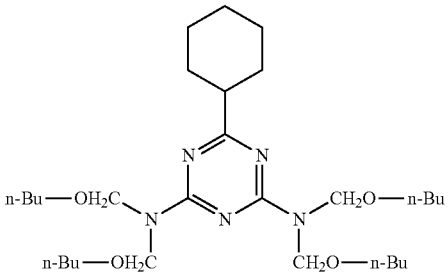
(C2-10)
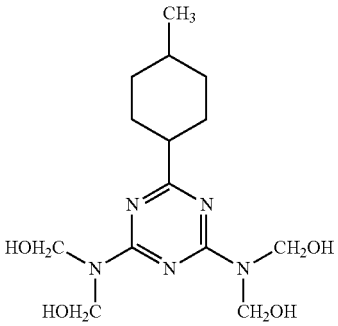
(C2-11)
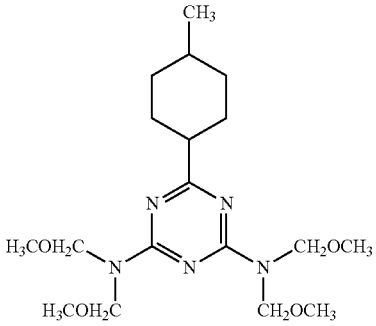
-continued
(C2-12)
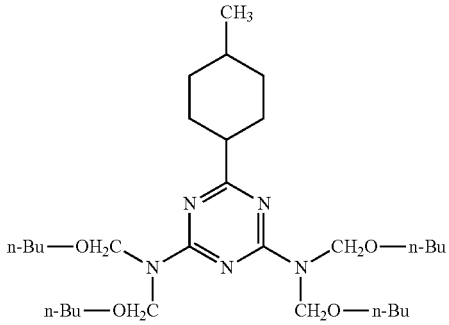
(C2-13)
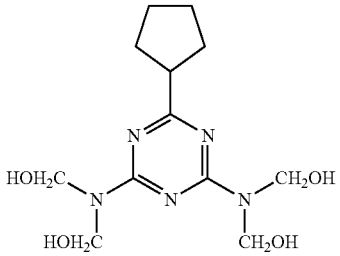
(C2-14)
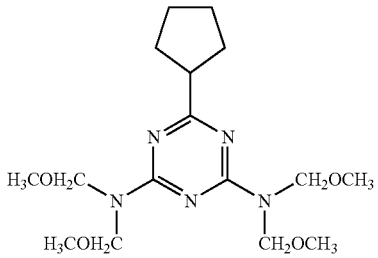
(C2-15)
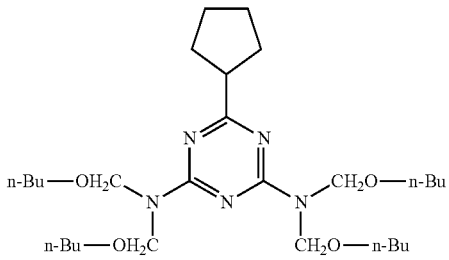
(C2-16)
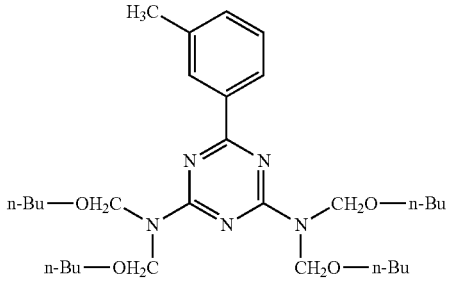

-continued
(C2-17)
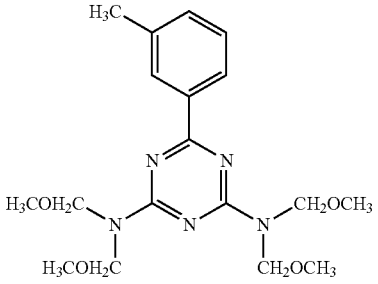
(C2-18)
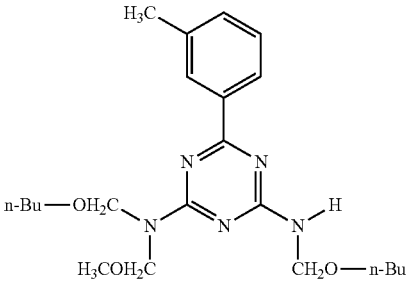
(C3-1)
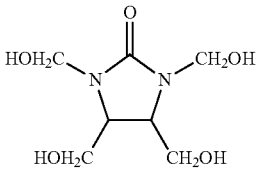
(C3-2)
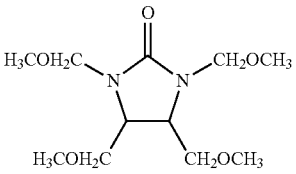
(C3-3)
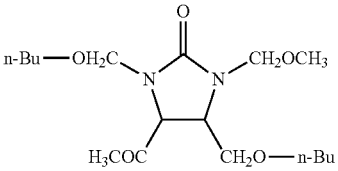
(C3-4)
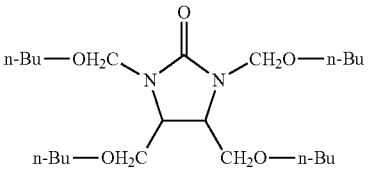
(C3-5)
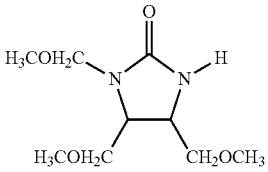
-continued
(C3-6)
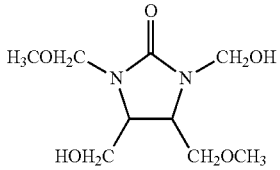
(C4-1)
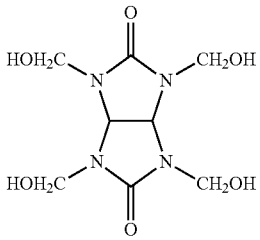
(C4-2)
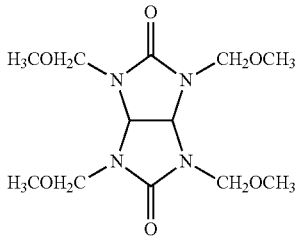
(C4-3)
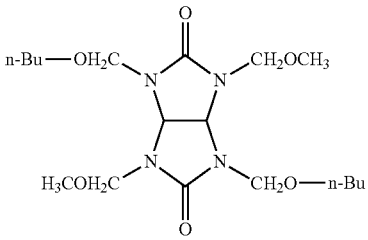
(C4-4)
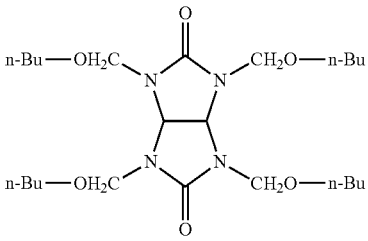
(C4-5)
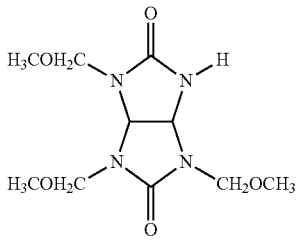

-continued (C4-6)

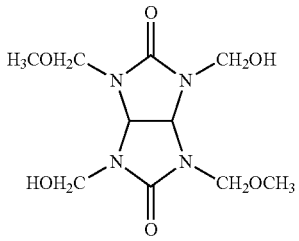

(C5-1)

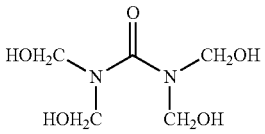

(C5-2)

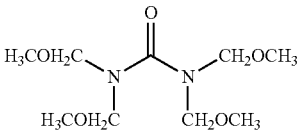

(C5-3)

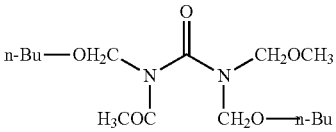

(C5-4)

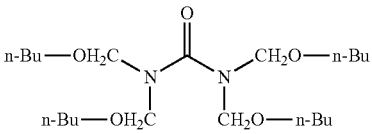

(C5-5)

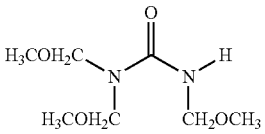

(C5-6)

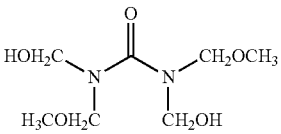

Next, the resin is described. The resin may be incorporated into the solution containing the electron transporting substance. Examples of the resin include a polyester resin, a polycarbonate resin, polyvinyl butyral, an acrylic resin, a silicone resin, an epoxy resin, a melamine resin, a urethane resin, a phenol resin, and an alkyd resin. In addition, when the electron transporting substance having a polymerizable functional group and the crosslinking agent are used, the resin having a polymerizable functional group is preferably used. Examples of the resin having a polymerizable functional group include resins each having a structural unit represented by the following formula (D).

(D)

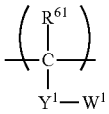

In the formula (D), $R^{61}$ represents a hydrogen atom or an alkyl group, $Y^1$ represents a single bond, an alkylene group, or a phenylene group, and $W^1$ represents a hydroxy group, a thiol group, an amino group, a carboxyl group, or a methoxy group. $W^1$ represents a polymerizable functional group.

Examples of a thermoplastic resin having the structural unit represented by the formula (D) include an acetal resin, a polyolefin resin, a polyester resin, a polyether resin, and a polyamide resin. The resin may have the structural unit represented by the formula (D) in any one of the characteristic structures shown below, or may have the structural unit in addition to the characteristic structure. The characteristic structures are represented by the following formulae (E-1) to (E-5). The formula (E-1) represents a structural unit of the acetal resin. The formula (E-2) represents a structural unit of the polyolefin resin. The formula (E-3) represents a structural unit of the polyester resin. The formula (E-4) represents a structural unit of the polyether resin. The formula (E-5) represents a structural unit of the polyamide resin.

(E-1)

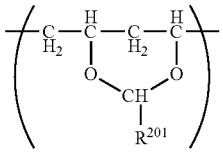

(E-2)

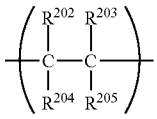

(E-3)

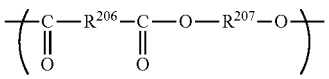

(E-4)

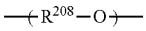

(E-5)

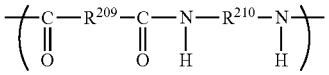

In the formulae, $R^{201}$ to $R^{205}$ each independently represent a substituted or unsubstituted alkyl group, or a substituted or unsubstituted aryl group. When $R^{201}$ represents $C_3H_7$, the characteristic structures is referred to as "butyral." In the formulae, $R^{206}$ to $R^{216}$ each independently represent a substituted or unsubstituted alkylene group, or a substituted or unsubstituted arylene group.

The resin having the structural unit represented by the formula (D) (hereinafter sometimes referred to as "resin D") is obtained by polymerizing, for example, a monomer having a polymerizable functional group available from Sigma-Aldrich Japan K.K. or Tokyo Chemical Industry, Co., Ltd.

Examples of a method of determining the polymerizable functional group in the resin include the following methods: the titration of a carboxyl group with potassium hydroxide; the titration of an amino group with sodium nitrite; the titration of a hydroxy group with acetic anhydride and potassium hydroxide; the titration of a thiol group with 5,5'-dithiobis(2-nitrobenzoic acid); and a method involving using a calibration curve obtained from the IR spectrum of a sample in which a polymerizable functional group introduction ratio has been changed.

Table 1 below shows specific examples of the resin D. The column "characteristic structure" in Table 1 shows the structural unit represented by any one of the formulae (E-1) to (E-5). In the present invention, the weight-average molecular weight of a resin means a weight average-molecular weight in terms of polystyrene measured by a usual method, specifically, a method described in Japanese Patent Application Laid-Open No. 2007-79555.

TABLE 1

| | Structure | | | Number of moles of functional | Characteristic | Weight-average molecular |
|---|---|---|---|---|---|---|
| | $R^{61}$ | $Y^1$ | $W^1$ | group per g | structure | weight |
| D1 | H | Single bond | OH | 3.3 mmol | Butyral | $1 \times 10^5$ |
| D2 | H | Single bond | OH | 3.3 mmol | Butyral | $4 \times 10^4$ |
| D3 | H | Single bond | OH | 3.3 mmol | Butyral | $2 \times 10^4$ |
| D4 | H | Single bond | OH | 1.0 mmol | Polyolefin | $1 \times 10^5$ |
| D5 | H | Single bond | OH | 3.0 mmol | Polyester | $8 \times 10^4$ |
| D6 | H | Single bond | OH | 2.5 mmol | Polyether | $5 \times 10^4$ |
| D7 | H | Single bond | OH | 2.8 mmol | Cellulose | $3 \times 10^4$ |
| D8 | H | Single bond | COOH | 3.5 mmol | Polyolefin | $6 \times 10^4$ |
| D9 | H | Single bond | NH2 | 1.2 mmol | Polyamide | $2 \times 10^5$ |
| D10 | H | Single bond | SH | 1.3 mmol | Polyolefin | $9 \times 10^3$ |
| D11 | H | Phenylene | OH | 2.8 mmol | Polyolefin | $4 \times 10^3$ |
| D12 | H | Single bond | OH | 3.0 mmol | Butyral | $7 \times 10^4$ |
| D13 | H | Single bond | OH | 2.9 mmol | Polyester | $2 \times 10^4$ |
| D14 | H | Single bond | OH | 2.5 mmol | Polyester | $6 \times 10^3$ |
| D15 | H | Single bond | OH | 2.7 mmol | Polyester | $8 \times 10^4$ |
| D16 | H | Single bond | COOH | 1.4 mmol | Polyolefin | $2 \times 10^5$ |
| D17 | H | Single bond | COOH | 2.2 mmol | Polyester | $9 \times 10^3$ |
| D18 | H | Single bond | COOH | 2.8 mmol | Polyester | $8 \times 10^2$ |
| D19 | CH3 | Alkylene | OH | 1.5 mmol | Polyester | $2 \times 10^4$ |
| D20 | C2H5 | Alkylene | OH | 2.1 mmol | Polyester | $1 \times 10^4$ |
| D21 | C2H5 | Alkylene | OH | 3.0 mmol | Polyester | $5 \times 10^4$ |
| D22 | H | Single bond | OCH3 | 2.8 mmol | Polyolefin | $7 \times 10^3$ |
| D23 | H | Single bond | OH | 3.3 mmol | Butyral | $2.7 \times 10^5$ |
| D24 | H | Single bond | OH | 3.3 mmol | Butyral | $4 \times 10^5$ |
| D25 | H | Single bond | OH | 2.5 mmol | Acetal | $3.4 \times 10^5$ |

The content of the electron transporting substance is preferably 30 mass % or more and 70 mass % or less with respect to the total mass of the total solid matter in the emulsion.

In addition, roughening particles may be incorporated as an additive into an electron transporting layer. Examples of the roughening particles include particles of a curable resin and metal oxide particles. In addition, an additive such as a silicone oil, a surfactant, or a silane compound may be incorporated.

In the present invention, the liquid whose solubility in water at 25° C. and 1 atmosphere is 3.0 mass % or less (hydrophobic solvent) is used. Table 2 shows typical examples of the hydrophobic solvent. In addition, the term "water solubility" in the table represents a solubility in water at 25° C. and 1 atmosphere (atmospheric pressure) in a mass % unit.

TABLE 2

| No. | Name | Water solubility |
|---|---|---|
| 1 | Toluene | 0.1 mass % |
| 2 | Chloroform | 0.8 mass % |
| 3 | o-Dichlorobenzene | 0.0 mass % |
| 4 | Chlorobenzene | 0.1 mass % |
| 5 | o-Xylene | 0.0 mass % |
| 6 | Ethylbenzene | 0.0 mass % |
| 7 | Cyclohexanone | 2.8 mass % |
| 8 | 2-Heptanone | 0.4 mass % |

Of those, toluene, xylene, or cyclohexanone is preferred from the viewpoint of the stabilization of the emulsion. Two or more kinds of the hydrophobic solvents may be used as a mixture.

It is preferred that in addition to the hydrophobic solvent, a liquid whose solubility in water at 25° C. and 1 atmosphere is 5.0 mass % or more (hydrophilic solvent) be incorporated into the solution of the present invention. Specific examples thereof include tetrahydrofuran, dimethoxymethane, 2-butanone, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate. Table 3 shows the water solubility of each of these hydrophobic solvents. In addition, in the table, the term "water solubility" refers to a solubility in water at 25° C. and 1 atmosphere (atmospheric pressure) in a mass % unit.

TABLE 3

| No. | Name | Water solubility |
|---|---|---|
| 1 | Tetrahydrofuran | 100.0 mass % or more |
| 2 | Dimethoxymethane | 32.3 mass % |
| 3 | 2-Butanone | 22.3 mass % |
| 4 | 1,2-Dioxane | 100.0 mass % or more |
| 5 | 1,3-Dioxane | 100.0 mass % or more |
| 6 | 1.4-Dioxane | 100.0 mass % or more |
| 7 | 1,3,5-Trioxane | 21.1 mass % |
| 8 | Methanol | 100.0 mass % or more |
| 9 | 2-Pentanone | 5.9 mass % |
| 10 | Ethanol | 100.0 mass % or more |
| 11 | Tetrahydropyran | 100.0 mass % or more |
| 12 | Diethylene glycol dimethyl ether | 100.0 mass % or more |
| 13 | Ethylene glycol dimethyl ether | 100.0 mass % or more |
| 14 | Propylene glycol n-butyl ether | 6.0 mass % |
| 15 | Propylene glycol monopropyl ether | 100.0 mass % or more |
| 16 | Ethylene glycol monoethyl ether | 100.0 mass % or more |
| 17 | Diethylene glycol monoethyl ether | 100.0 mass % or more |
| 18 | Ethylene glycol monoisopropyl ether | 100.0 mass % or more |
| 19 | Ethylene glycol monobutyl ether | 100.0 mass % or more |
| 20 | Ethylene glycol monoisobutyl ether | 100.0 mass % or more |
| 21 | Ethylene glycol monoallyl ether | 100.0 mass % or more |
| 22 | Propylene glycol monomethyl ether | 100.0 mass % or more |
| 23 | Dipropylene glycol monomethyl ether | 100.0 mass % or more |
| 24 | Tripropylene glycol monomethyl ether | 100.0 mass % or more |
| 25 | Propylene glycol monobutyl ether | 6.4 mass % |
| 26 | Propylene glycol monoethyl ether acetate | 20.5 mass % |
| 27 | Diethylene glycol methyl ethyl ether | 100.0 mass % or more |
| 28 | Diethylene glycol diethyl ether | 100.0 mass % or more |
| 29 | Dipropylene glycol dimethyl ether | 37.0 mass % |
| 30 | Propylene glycol diacetate | 7.4 mass % |
| 31 | Methyl acetate | 19.6 mass % |
| 32 | Ethyl acetate | 8.3 mass % |
| 33 | n-Propyl alcohol | 100.0 mass % or more |
| 34 | 3-Methoxyethanol | 100.0 mass % or more |
| 35 | 3-Methoxybutyl acetate | 6.5 mass % |
| 36 | Ethylene glycol monomethyl ether acetate | 100.0 mass % or more |

Of those, an ether-based solvent is preferred, and of the ether-based solvents, tetrahydrofuran, 2-butanone, or dimethoxymethane is more preferred from the viewpoint of the stabilization of the emulsion. Two or more kinds of the hydrophilic solvents can be used as a mixture. In particular, when the coat of the emulsion is formed on the support by dip coating in the step of applying the coat onto the support to be described later, a hydrophilic solvent having a relatively low boiling point, e.g., 100° C. or less is preferably used. This is because of the following reason: the solvent is quickly removed in the step of heating the coat and hence the uniformity of the surface of the undercoat layer can be easily controlled.

The mass of the liquid whose solubility in water at 25° C. and 1 atmosphere is 3.0 mass % or less is represented by (a), and the mass of the liquid whose solubility in water at 25° C. and 1 atmosphere is 5.0 mass % or more is represented by (b). At this time, the ratio (a/b) of (a) to (b) is preferably 1/9 to 9/1, more preferably 2/8 to 9/1. Thus, in the step of producing the emulsion to be described later, the oil droplets in the emulsion are reduced in diameter and hence the emulsion is additionally stabilized.

Upon preparation of the emulsion, the viscosity of the solution containing the electron transporting substance is preferably set to fall within a moderate range from the viewpoint of the stability of the emulsion. Specifically, the electron transporting substance and any other undercoat layer constituting material are preferably dissolved at a ratio in the range of from 3 mass % or more to 50 mass % or less with respect to the total mass of the hydrophobic solvent and the hydrophilic solvent. The viscosity of the solution preferably falls within the range of from 1 mPa·s or more to 300 mPa·s or less.

Next, the step of producing the emulsion by dispersing the solution in water is described.

An existing method can be employed as a method of preparing the emulsion. Hereinafter, a stirring method and a high-pressure collision method are described as specific methods, but the production process of the present invention is not limited thereto.

The stirring method is described. The undercoat layer constituting materials such as the resin and the crosslinking agent, and the electron transporting substance are dissolved in the hydrophobic solvent to prepare a solution. After the solution has been weighed, water as a dispersion medium is weighed, and the solution and the water are mixed. After that, the mixture is stirred with a stirring machine. Here, the water to be used as the dispersion medium is preferably ion-exchanged water from which a metal ion or the like has been removed with an ion exchange resin or the like from the viewpoints of electrophotographic characteristics. The conductivity of the ion-exchanged water is preferably 5 μS/cm or less. The stirring machine is preferably a stirring machine capable of high-speed stirring because uniform dispersion can be performed within a short time period, and the machine is, for example, a homogenizer.

The high-pressure collision method is described. The undercoat layer constituting materials such as the resin and the crosslinking agent, and the electron transporting substance are dissolved in the hydrophobic solvent to prepare a solution. After the solution has been weighed, water as a dispersion medium is weighed, and the solution and the water are mixed. After that, the mixed liquids are caused to collide with each other under high pressure, whereby the emulsion can be obtained. In addition, the emulsion may be obtained by causing the solution and the water as separate liquids to collide with each other without mixing the liquids. A dispersing apparatus is, for example, a microfluidizer.

In the emulsion, the mass of the water is represented by (w), the mass of the hydrophobic solvent is represented by (a), the mass of the hydrophilic solvent is represented by (b), the mass of the electron transporting substance is represented by (ct), the mass of the resin is represented by (r), and the mass of the crosslinking agent is represented by (k). At this time, the ratio (w/(a+b+r+ct+k)) of (w) to (a+b+r+ct+k) is preferably 4/6 to 8/2 from the viewpoint of the stabilization of the emulsion. The ratio is more preferably 5/5 to 7/3. In addition, the ratio of the water to the organic solvents (the hydrophobic solvent and the hydrophilic solvent) is preferably as high as possible from the viewpoint of reducing the diameter of each oil droplet in the emulsion to stabilize the emulsion.

The ratio of the undercoat layer constituting materials such as the resin and the crosslinking agent, and the electron transporting substance to the organic solvents (the hydrophobic solvent and the hydrophilic solvent) in each oil droplet is preferably 3 to 50 mass %. A ratio between the electron transporting substance, and the resin and/or the crosslinking agent falls within the range of preferably from 2:7 to 10:0 (mass ratio), more preferably from 3:7 to 7:3 (mass ratio). In addition, when the additive is further added to the materials, its ratio is preferably 50 mass % or less, more preferably 30 mass % or less with respect to the solid matter of the electron transporting substance, the resin, and the crosslinking agent.

In addition, a surfactant may be incorporated into the emulsion of the present invention for the purpose of additionally stabilizing the emulsification. The surfactant is preferably a nonionic surfactant. Specific examples of the nonionic surfactant include: a NAROACTY series, an EMULMIN series, a SANNONIC series, and a NEWPOL series manufactured by Sanyo Chemical Industries, Ltd.; an EMULGEN series, a RHEODOL series, and an EMANON series manufactured by Kao Corporation; an ADEKA TOL series, an ADEKA ESTOL series, and an ADEKA NOL series manufactured by ADEKA CORPORATION; and a series of nonionic surfactants out of a NEWCOL series manufactured by NIPPON NYUKAZAI CO., LTD. One kind of those surfactants can be used alone, or two or more kinds thereof can be used in combination. The addition amount of the surfactant is preferably as small as possible from the following viewpoint: the electrophotographic characteristics should not be impaired. The content of the surfactant in the emulsion falls within the range of preferably from 0 mass % to 5.0 mass %, more preferably from 0 mass % to 1.5 mass %. In addition, the surfactant may be added to the water as the dispersion medium in advance, or may be added to the solution in which the electron transporting substance has been dissolved. Alternatively, the surfactant may be added to each of both the medium and the solution before the emulsification. In addition, a defoaming agent, a viscoelasticity modifier, or the like may be incorporated into the emulsion to the extent that the effect of the present invention is not impaired, and any such agent is effective when the agent is water-soluble.

The average particle diameter of each of the oil droplets of the emulsion produced as described above preferably falls within the range of from 0.1 to 20.0 μm from the viewpoint of the stability of the emulsion. The average particle diameter more preferably falls within the range of from 0.1 to 5.0 μm.

Next, the step of forming the coat of the emulsion on the support is described.

As a method of forming the coat of the emulsion, there may be given, for example, a dip coating method, a ring coating method, a spray coating method, a spinner coating method, a roller coating method, a Meyer bar coating method, and a blade coating method. Of those, a dip coating method is preferred from the viewpoint of productivity.

Next, the step of heating the coat is described.

The coat formed on the support is heated to form the undercoat layer. The dispersion medium is removed, and at the same time, the oil droplets each containing the electron transporting substance are brought into close contact with each other by the heating step, whereby an undercoat layer having high uniformity can be formed. It is preferred that the particle diameter of each oil droplet be additionally reduced because the uniformity of the thickness of the undercoat layer quickly improves after the removal of the dispersion medium. The heating is preferably performed at a temperature of 100° C. or more. In terms of an improvement in adhesiveness between the oil droplets, the heating temperature is more preferably equal to or more than the melting point of the electron transporting substance having the lowest melting point out of the electron transporting substances constituting the undercoat layer because an undercoat layer having additionally high uniformity can be formed. In addition, the heating temperature is preferably 200° C. or less because the denaturation and the like of the electron transporting substance occur when the heating temperature is excessively high.

The thickness of the undercoat layer is preferably 0.1 μm or more and 30 μm or less, more preferably 0.3 μm or more and 5 μm or less.

(Support)

The support is preferably a support having conductivity (conductive support). For example, a support made of a metal such as aluminum, nickel, copper, gold, or iron, or an alloy thereof can be used. Examples thereof include: a support obtained by forming a thin film of a metal such as aluminum, silver, or gold on an insulating support made of, for example, a polyester resin, a polycarbonate resin, a polyimide resin, or a glass; and a support obtained by forming a thin film of a conductive material such as indium oxide or tin oxide.

The surface of the support may be subjected to electrochemical treatment such as anodization, or treatment such as wet honing treatment, blasting treatment, or cutting treatment for improvements in electrical characteristics and the suppression of interference fringes.

A conductive layer may be formed between the support and the undercoat layer. The conductive layer is obtained by: forming the coat of an application liquid for a conductive layer, which is obtained by dispersing conductive particles in a resin, on the support; and drying the coat. Examples of the conductive particles include carbon black, acethylene black, metal powders made of, for example, aluminum, nickel, iron, nichrome, copper, zinc, and silver, and metal oxide powders made of, for example, conductive tin oxide and ITO.

Examples of the resin to be used in the conductive layer include a polyester resin, a polycarbonate resin, a polyvinyl butyral resin, an acrylic resin, a silicone resin, an epoxy resin, a melamine resin, a urethane resin, a phenol resin, and an alkyd resin.

Examples of the solvent for the application liquid for a conductive layer include an ether-based solvent, an alcohol-based solvent, a ketone-based solvent, and an aromatic hydrocarbon solvent.

The thickness of the conductive layer is preferably 0.2 μm or more and 40 μm or less, more preferably 1 μm or more and 35 μm or less, still more preferably 5 μm or more and 30 μm or less. In addition, the conductive layer may be formed between the undercoat layer and charge generating layer of the present invention.

(Charge Generating Layer)

The charge generating layer is formed on the undercoat layer.

Examples of the charge generating substance include azo pigments, perylene pigments, indigo derivatives, and phthalocyanine pigments. Of those, at least one of azo pigments or phthalocyanine pigments is preferred. Of the phthalocyanine pigments, oxytitanium phthalocyanine, chlorogallium phthalocyanine, or hydroxygallium phthalocyanine is preferred.

As a binder resin to be used for the charge generating layer, there are given, for example: a polymer and copolymer of a vinyl compound such as styrene, vinyl acetate, vinyl chloride, an acrylic acid ester, a methacrylic acid ester, vinylidene fluoride, or trifluoroethylene; and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, and an epoxy resin. Of those, a polyester resin, a polycarbonate resin, or a polyvinyl acetal resin is preferred, and a polyvinyl acetal resin is more preferred.

The charge generating layer can be formed by: forming the coat of an application liquid for a charge generating layer obtained by dispersing the charge generating substance together with a resin and a solvent; and drying the resultant coat. In addition, the charge generating layer may be a deposited film of the charge generating substance.

The mass ratio (charge generating substance/binder resin) of the charge generating substance to the binder resin in the charge generating layer falls within the range of preferably from 10/1 to 1/10, more preferably from 5/1 to 1/5.

Examples of the solvent to be used in the application liquid for a charge generating layer include an alcohol-based solvent, a sulfoxide-based solvent, a ketone-based solvent, an ether-based solvent, an ester-based solvent, and an aromatic hydrocarbon solvent. The thickness of the charge generating layer is preferably 0.05 μm or more and 5 μm or less.

Further, any of various sensitizers, antioxidants, UV absorbents, plasticizers, and the like may be added to the charge generating layer as required. An electron transporting substance or an electron accepting substance may also be incorporated into the charge generating layer to prevent the flow of charge from being disrupted in the charge generating layer.

(Hole Transporting Layer)

The hole transporting layer is formed on the charge generating layer. The hole transporting layer contains a hole transporting substance and a binder resin.

Examples of the hole transporting substance include a polycyclic aromatic compound, a heterocyclic compound, a hydrazone compound, a styryl compound, a benzidine compound, a triarylamine compound, triphenylamine, and a polymer having a group derived from any one of these compounds in its main chain or side chain. Of those, a triarylamine compound, a benzidine compound, or a styryl compound is preferred.

As a binder resin to be used for the hole transporting layer, there are given, for example, a polyester resin, a polycarbonate resin, a polymethacrylate resin, a polyarylate resin, a polysulfone resin, and a polystyrene resin. Of those, a polycarbonate resin and a polyarylate resin are preferred. In addition, the binder resin preferably has a weight-average molecular weight (Mw) of from 10,000 to 300,000 as its molecular weight.

The mass ratio (hole transporting substance/binder resin) of the hole transporting substance to the binder resin in the hole transporting layer is preferably 10/5 to 5/10, more preferably 10/8 to 6/10. The thickness of the hole transporting layer is preferably 3 μm or more and 40 μm or less, more preferably 5 μm or more and 16 μm or less.

In addition, the hole transporting layer may contain an additive in addition to the hole transporting substance and the binder resin. Specific examples of the additive include: a deterioration-preventing agent such as an antioxidant, a UV absorber, or a light stabilizer; and a resin for imparting releasability. Examples of the deterioration-preventing agent include a hindered phenol-based antioxidant, a hindered amine-based light stabilizer, a sulfur atom-containing antioxidant, and a phosphorus atom-containing antioxidant. Examples of the resin for imparting releasability include a fluorine atom-containing resin and a resin having a siloxane structure.

As a solvent to be used for the application liquid for a hole transporting layer, there is given, for example, an alcohol-based solvent, a sulfoxide-based solvent, a ketone-based solvent, an ether-based solvent, an ester-based solvent, or an aromatic hydrocarbon solvent.

In addition, a protective layer may be formed on the hole transporting layer. The protective layer contains conductive particles or a charge transporting substance and a binder resin. In addition, the protective layer may further contain an additive such as a lubricant. In addition, conductivity or charge transporting property may be imparted to the binder resin itself of the protective layer. In that case, the conductive particles or the charge transporting substance except the resin may not be incorporated into the protective layer. In addition, the binder resin of the protective layer may be a thermoplastic resin, or may be a curable resin obtained by polymerization with, for example, heat, light, or a radiation (such as an electron beam).

Preferred as a method of forming each of the layers is a method involving: applying an application liquid obtained by dissolving and/or dispersing a material constituting the layer in a solvent to form a coat; and drying and/or curing the resultant coat to form the layer. Examples of a method of applying the application liquid include a dip coating method, a spray coating method, a curtain coating method, and a spin coating method. Of those, a dip coating method is preferred from the viewpoints of efficiency and productivity.

(Process Cartridge and Electrophotographic Apparatus)

FIG. 1 illustrates the schematic construction of an electrophotographic apparatus including a process cartridge including an electrophotographic photosensitive member.

In FIG. 1, a cylindrical electrophotographic photosensitive member 1 can be driven to rotate about an axis 2 in the direction indicated by the arrow at a predetermined peripheral speed. The surface (peripheral surface) of the electrophotographic photosensitive member 1 driven to rotate is uniformly charged at a predetermined positive or negative potential by a charging unit 3 (primary charging unit: such as a charging roller). Subsequently, the surface of the electrophotographic photosensitive member 1 receives exposure light (image exposure light) 4 from an exposing unit (not shown) such as a slit exposure or a laser-beam scanning exposure. In this way, electrostatic latent images corresponding to images of interest are sequentially formed on the surface of the electrophotographic photosensitive member 1.

The electrostatic latent images formed on the surface of the electrophotographic photosensitive member 1 are then converted into toner images by development with toner included in a developer of a developing unit 5. Subsequently, the toner images being formed and held on the surface of the electrophotographic photosensitive member 1 are sequentially transferred to a transfer material (such as paper) P by a transfer bias from a transferring unit (such as transfer roller) 6. It should be noted that the transfer material P is taken from a transfer material supplying unit (not shown) in synchronization with the rotation of the electrophotographic photosensitive member 1 and fed to a portion (contact part) between the electrophotographic photosensitive member 1 and the transferring unit 6.

The transfer material P which has received the transfer of the toner images is dissociated from the surface of the electrophotographic photosensitive member 1 and then introduced to a fixing unit 8. The transfer material P is subjected to an image fixation of the toner images and then printed as an image-formed product (print or copy) out of the apparatus.

The surface of the electrophotographic photosensitive member 1 after the transfer of the toner images is cleaned by removal of the remaining developer (toner) after the transfer by a cleaning unit (such as cleaning blade) 7. Subsequently, the surface of the electrophotographic photosensitive member 1 is subjected to a neutralization process with pre-exposure light (not shown) from a pre-exposing unit (not shown) and then repeatedly used in image formation. It should be noted that as illustrated in FIG. 1, when the charging unit 3 is a contact-charging unit using a charging roller or the like, the pre-exposure is not always required.

Of the structural components including the electrophotographic photosensitive member 1, the charging unit 3, the developing unit 5, the transferring unit 6, and the cleaning unit 7, a plurality of them may be selected and housed in a container and integrally combined as a process cartridge. The process cartridge may be designed so as to be detachably mountable to the main body of an electrophotographic apparatus such as a copying machine or a laser beam printer. In FIG. 1, the electrophotographic photosensitive member 1, the charging unit 3, the developing unit 5, and the cleaning unit 7 are integrally supported and placed in a cartridge, thereby forming a process cartridge 9. The process cartridge 9 is detachably mountable to the main body of the electrophotographic apparatus using a guiding unit 10 such as a rail of the main body of the electrophotographic apparatus.

EXAMPLES

Hereinafter, the present invention is described by way of Emulsion Production Examples and Examples. However, the present invention is not limited thereto. It should be noted that "part(s)" means "part(s) by mass" in Examples.

Emulsion Production Example 1

An emulsion for an undercoat layer containing an electron transporting substance was produced by the following method.

7 Parts of a compound represented by the following formula (A-1) (melting point: 160 to 162° C.) as the electron transporting substance and 3 parts of the resin (D1) (in the formula (E-1), $R^{201}$ represented $C_3H_7$) described in Table 1 were dissolved in 30 parts of toluene to prepare a solution. Next, 1.5 parts of NOIGEN EA-167 (manufactured by Daiichi Kogyo Seiyaku Co., Ltd., HLB=14.8) as a surfactant were added to 58.5 parts of ion-exchanged water (conductivity: 0.2 μS/cm), and 40 parts of the solution were gradually added to the mixture over 10 minutes while the mixture was stirred with a homogenizer at 3,000 rotations, thereby preparing an emulsion (100 parts). Further, the emulsion was stirred for 20 minutes while the number of rotations was increased to 7,000 rotations. Thus, an emulsion 1 (100 parts) was obtained.

The resultant emulsion was evaluated for its liquid stability as described below.

(A-1)

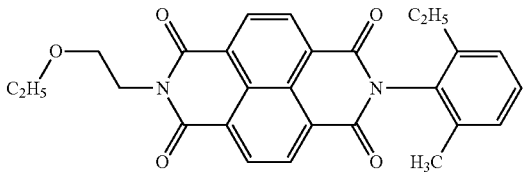

As an evaluation method, the emulsion was left at rest for 2 weeks (under an environment having a temperature of 23° C. and a humidity of 50%) after its preparation by the method. Its state after the standing was observed and then the emulsion was stirred with a homogenizer at 1,000 rotations/min for 3 minutes. The state of the emulsion after the stirring was similarly observed with the eyes. In addition, the particle diameters of emulsion particles (oil droplets) were measured by performing the measurement of their average particle diameter before the standing and after the stirring after the standing. It should be noted that the measurement of the average particle diameter was performed as follows: the emulsion was diluted with water and the average particle diameter of each of the emulsion particles was measured with an ultracentrifugal automatic particle size distribution measuring apparatus (CAPA700) manufactured by HORIBA, Ltd.

The state of the emulsion obtained in Production Example 1 after the standing was a state where the average particle diameter increased as compared to that immediately after its preparation. However, the emulsion did not separate and maintained its emulsified state. Table 5-1 shows the result of the evaluation.

Emulsion Production Examples 2 to 53

Emulsions were each prepared by the same method as that of Emulsion Production Example 1 except that: the kinds and ratios of the electron transporting substance, the resin, and the crosslinking agent were changed as shown in Table 4 in the preparation of the emulsion containing the electron transporting substance by the same method as that of Emulsion Production Example 1; and the ratio (mass ratio) of the hydrophobic solvent to the hydrophilic solvent and the kinds of the solvents were changed, and the ratio of water to the solvents was changed as shown in Tables 5-1, 5-2, 6-1 and 6-2. Tables 5-1, 5-2, 6-1 and 6-2 show the results of the evaluations of the resultant emulsions for their liquid stabilities. When an isocyanate compound having blocked isocyanate groups was used as crosslinking agent, the isocyanate compound and the blocked isocyanate group are listed in table 4.

It should be noted that the electron transporting substances used in the emulsion production examples are represented by the following formulae. The melting point of a compound represented by the following formula (A-2) is 180 to 181° C. and the melting point of a compound represented by the following formula (A-3) is 120 to 122° C. Specific structures of the characteristic structure (E−1) of the D25 are as follows: the D25 has two kinds of structures, i.e., a structure in which $R^{201}$ represents $CH_3$ and a structure in which $R^{201}$ represents $C_2H_5$. In the characteristic structure (E-3) of the D20, $R^{206}$ represents $CH_2$ and $R^{207}$ represents $CH_2$.

(A-2)

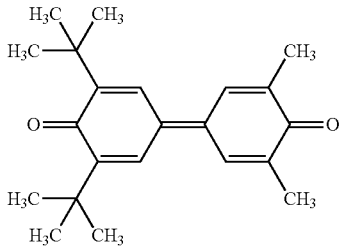

(A-3)

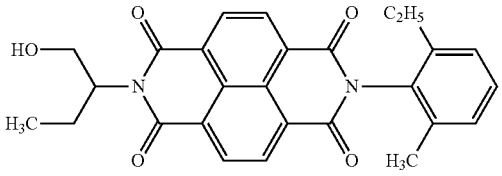

In addition, the kinds of the surfactants used in the emulsion production examples were as described below. In each of Emulsion Production Examples 1 to 28, 40 to 45, and 51 to 53, NOIGEN EA-167 (manufactured by Dai-ichi Kogyo Seiyaku Co., Ltd., HLB=14.8) was used. In each of Emulsion Production Examples 29 to 33, NAROACTY CL-85 (manufactured by Sanyo Chemical Industries, Ltd., HLB=12.6) was used. In each of Emulsion Production Examples 34 to 39, EMULGEN MS-110 (manufactured by Kao Corporation, HLB=12.7) was used.

In addition, the catalysts used in the emulsion production examples were as described below. In each of Emulsion Production Examples 7 to 39 and 48 to 53, 0.03 part of dioctyltin dilaurate was used. In each of Emulsion Production Examples 40 to 45, 0.1 part of dodecylbenzenesulfonic acid was used.

TABLE 4

| Emulsion | Electron transporting substance (ct) | | Resin (r) | | Crosslinking agent (k) | | |
|---|---|---|---|---|---|---|---|
| Production Example | Kind | Mass (part(s)) | Kind | Mass (part(s)) | Kind | Mass (part(s)) | (ct)/(r + k) |
| 1 | (A-1) | 7 | (D1) | 3 | — | — | 7/3 |
| 2 | (A-1) | 5 | (D25) | 5 | — | — | 5/5 |
| 3 | (A-1) | 6 | (D25) | 4 | — | — | 6/4 |
| 4 | (A-2) | 6 | (D2) | 4 | — | — | 6/4 |
| 5 | (A-2) | 4 | (D5) | 6 | — | — | 4/6 |
| 6 | (A-2) | 5 | (D25) | 5 | — | — | 5/5 |
| 7 | (A-3) | 5 | (D25) | 2 | B1:H5 | 3 | 5/5 |
| 8 | (A-3) | 6 | (D25) | 1 | B1:H5 | 3 | 6/4 |
| 9 | (A-3) | 5 | (D25) | 2 | B1:H5 | 3 | 5/5 |
| 10 | (A-3) | 5 | (D25) | 2 | B1:H1 | 3 | 5/5 |
| 11 | (A-3) | 5 | (D25) | 1 | B1:H5 | 4 | 5/5 |
| 12 | (A-3) | 5 | (D25) | 2 | B1:H1 | 3 | 5/5 |
| 13 | (A-3) | 4 | (D25) | 2 | B1:H5 | 4 | 4/6 |
| 14 | (A-3) | 5 | (D25) | 2 | B1:H1 | 3 | 5/5 |
| 15 | (A-3) | 4 | (D25) | 3 | B1:H5 | 3 | 4/6 |
| 16 | (A-3) | 5 | (D25) | 2 | B1:H3 | 3 | 5/5 |
| 17 | (A-3) | 5 | (D25) | 1 | B1:H5 | 4 | 5/5 |
| 18 | (A-3) | 5 | (D25) | 1 | B7:H1 | 4 | 5/5 |
| 19 | (A-3) | 6 | (D25) | 1 | B1:H5 | 3 | 6/4 |
| 20 | (A-1) | 5 | (D25) | 2 | B15:H1 | 3 | 5/5 |
| 21 | (A-3) | 5 | (D25) | 2 | B1:H5 | 3 | 5/5 |
| 22 | (A-3) | 7 | (D25) | 0.5 | B1:H5 | 2.5 | 7/3 |
| 23 | (A-1) | 5 | (D25) | 2 | B1:H5 | 3 | 5/5 |
| 24 | (A-3) | 5 | (D25) | 1 | B1:H5 | 4 | 5/5 |
| 25 | (A-3) | 2 | (D25) | 4 | B20:H1 | 4 | 2/8 |
| 26 | (A-3) | 5 | (D25) | 2 | B1:H5 | 3 | 5/5 |
| 27 | (A-3) | 5 | (D25) | 2 | B16:H5 | 3 | 5/5 |
| 28 | (A-3) | 5 | (D25) | 1.5 | B1:H5 | 3.5 | 5/5 |

TABLE 4-continued

| Emulsion Production Example | Electron transporting substance (ct) Kind | Electron transporting substance (ct) Mass (part(s)) | Resin (r) Kind | Resin (r) Mass (part(s)) | Crosslinking agent (k) Kind | Crosslinking agent (k) Mass (part(s)) | (ct)/(r + k) |
|---|---|---|---|---|---|---|---|
| 29 | (A-3) | 5 | (D25) | 1.5 | B1:H5 | 3.5 | 5/5 |
| 30 | (A-3) | 4 | (D25) | 1.5 | B1:H5 | 4.5 | 4/6 |
| 31 | (A-3) | 5 | (D25) | 1 | B1:H5 | 4 | 5/5 |
| 32 | (A-3) | 4 | (D25) | 2 | B1:H5 | 4 | 4/6 |
| 33 | (A-3) | 5 | (D25) | 2.5 | B1:H5 | 2.5 | 5/5 |
| 34 | (A-3) | 4 | (D25) | 1.5 | B1:H1 | 4.5 | 4/6 |
| 35 | (A-3) | 4 | (D25) | 2 | B1:H2 | 4 | 4/6 |
| 36 | (A-3) | 4 | (D25) | 3 | B1:H6 | 3 | 4/6 |
| 37 | (A-3) | 4 | (D25) | 2.5 | B1:H7 | 3.5 | 4/6 |
| 38 | (A-3) | 4 | (D25) | 2 | B1:H2 | 4 | 4/6 |
| 39 | (A-3) | 4 | (D25) | 2 | B1:H5 | 4 | 4/6 |
| 40 | (A-3) | 5 | (D20) | 2 | C1-6 | 3 | 5/5 |
| 41 | (A-3) | 6 | (D1) | 2 | C1-2 | 2 | 6/4 |
| 42 | (A-3) | 6 | (D25) | 2 | C1-7 | 2 | 6/4 |
| 43 | (A-3) | 5 | (D20) | 2 | C2-9 | 2 | 5/5 |
| 44 | (A-3) | 5 | (D20) | 2 | C2-4 | 2 | 5/5 |
| 45 | (A-3) | 5 | (D25) | 2 | C4-2 | 2 | 5/5 |
| 46 | (A-1) | 7 | (D1) | 3 | — | — | 7/3 |
| 47 | (A-2) | 6 | (D2) | 4 | — | — | 6/4 |
| 48 | (A-3) | 6 | (D25) | 1 | B1:H5 | 3 | 6/4 |
| 49 | (A-3) | 6 | (D25) | 1 | B1:H5 | 3 | 6/4 |
| 50 | (A-3) | 6 | (D25) | 1 | B1:H5 | 3 | 6/4 |
| 51 | (A-3) | 6 | (D25) | 1 | B1:H5 | 3 | 6/4 |
| 52 | (A-3) | 6 | (D25) | 1 | B1:H5 | 3 | 6/4 |
| 53 | (A-3) | 6 | (D25) | 1 | B1:H5 | 3 | 6/4 |

TABLE 5-1

| Emulsion Production Example | Kinds and ratios of organic solvents: Hydrophobic organic solvent | Hydrophillic organic solvent | Hydrophobic/hydrophillic | Water/solution | Amount of surfactant (mass %) | Evaluation for liquid stability: Immediately after preperation: Visual observation | Average particle diameter | After stirring after 2 weeks of standing: Visual observation | Average particle diameter |
|---|---|---|---|---|---|---|---|---|---|
| 1 | Toluene | — | 10/0 | 6/4 | 1.5 | Uniformly bluish white color | 3.5 μm | Opaque white color | 7.7 μm |
| 2 | o-Xylene | — | 10/0 | 5/5 | 1.5 | Uniformly bluish white color | 3.1 μm | Opaque white color | 7.3 μm |
| 3 | Cyclohexanone | — | 10/0 | 5/5 | 1.5 | Uniformly bluish white color | 3.4 μm | Opaque white color | 8.6 μm |
| 4 | Toluene | 2-Butanone | 6/4 | 6/4 | 1.5 | Uniformly semitransparent | 1.6 μm | Uniformly semitransparent | 1.7 μm |
| 5 | o-Xylene | Tetrahydrofuran | 5/5 | 5/5 | 1.5 | Uniformly transparent | 0.8 μm | Uniformly semitransparent | 1.3 μm |
| 6 | Cyclohexanone | Dimethoxymethane | 7/3 | 6/4 | 1.5 | Uniformly transparent | 1.0 μm | Uniformly semitransparent | 1.8 μm |
| 7 | Cyclohexanone | 1,2-Dioxane | 9/1 | 4/6 | 1.5 | Uniformly bluish white color | 3.5 μm | Uniformly bluish white color | 4.2 μm |
| 8 | Cyclohexanone | 1,3-Dioxane | 6/4 | 6/4 | 1.5 | Uniformly bluish white color | 3.8 μm | Uniformly bluish white color | 4.1 μm |
| 9 | Cyclohexanone | 1,4-Dioxane | 5/5 | 8/2 | 1.5 | Uniformly bluish white color | 4.3 μm | Uniformly bluish white color | 4.5 μm |
| 10 | o-Dichlorobenzene | 1,3,5-Trioxane | 7/3 | 6/4 | 1.5 | Uniformly bluish white color | 4.1 μm | Uniformly bluish white color | 4.2 μm |
| 11 | Cyclohexanone | Methanol | 6/4 | 7/3 | 1.5 | Uniformly bluish white color | 3.8 μm | Uniformly bluish white color | 4.2 μm |
| 12 | Cyclohexanone | 2-Pentanone | 5/5 | 6/4 | 1.5 | Uniformly bluish white color | 3.8 μm | Uniformly bluish white color | 4.3 μm |
| 13 | Toluene | Ethanol | 2/8 | 6/4 | 1.5 | Uniformly bluish white color | 3.5 μm | Uniformly bluish white color | 3.2 μm |
| 14 | o-Xylene | Tetrahydropyran | 2/8 | 6/4 | 1.5 | Uniformly bluish white color | 4.2 μm | Uniformly bluish white color | 4.5 μm |
| 15 | Cyclohexanone | Diethylene glycol dimethyl ether | 7/3 | 6/4 | 1.5 | Uniformly semitransparent | 2.8 μm | Uniformly bluish white color | 3.2 μm |

TABLE 5-2

| Emulsion Production Example | Kinds and ratios of organic solvents: Hydrophobic organic solvent | Hydrophillic organic solvent | Hydrophobic/hydrophillic | Water/solution | Amount of surfactant (mass %) | Evaluation for liquid stability: Immediately after preperation: Visual observation | Average particle diameter | After stirring after 2 weeks of standing: Visual observation | Average particle diameter |
|---|---|---|---|---|---|---|---|---|---|
| 16 | Cyclohexanone | Ethylene glycol dimethyl ether | 9/1 | 6/4 | 1.5 | Uniformly bluish white color | 4.6 μm | Uniformly bluish white color | 3.7 μm |

TABLE 5-2-continued

| Emulsion Production Example | Kinds and ratios of organic solvents: Hydrophobic organic solvent | Hydrophillic organic solvent | Hydrophobic/ hydrophillic | Water/ solution | Amount of surfactant (mass %) | Evaluation for liquid stability: Immediately after preperation: Visual observation | Average particle diameter | After stirring after 2 weeks of standing: Visual observation | Average particle diameter |
|---|---|---|---|---|---|---|---|---|---|
| 17 | Chloroform | Propylene glycol n-butyl ether | 9/1 | 6/4 | 1.5 | Uniformly bluish white color | 5.5 μm | Uniformly bluish white color | 5.7 μm |
| 18 | Cyclohexanone | Propylene glycol monopropyl ether | 6/4 | 7/3 | 1.5 | Uniformly semitransparent | 2.2 μm | Uniformly semitransparent | 2.5 μm |
| 19 | Chlorobenzene | Ethylene glycol monomethyl ether | 5/5 | 5/5 | 1.5 | Uniformly bluish white color | 4.7 μm | Uniformly bluish white color | 4.8 μm |
| 20 | Cyclohexanone | Diethylene glycol monoethyl ether | 5/5 | 6/4 | 1.5 | Uniformly semitransparent | 2.7 μm | Uniformly semitransparent | 3.0 μm |
| 21 | o-Dichlorobenzene | Ethylene glycol monoisopropyl ether | 6/4 | 7/3 | 1.5 | Uniformly bluish white color | 4.6 μm | Uniformly bluish white color | 4.8 μm |
| 22 | Cyclohexanone | Ethylene glycol monobutyl ether | 7/3 | 6/4 | 1.5 | Uniformly bluish white color | 3.8 μm | Uniformly bluish white color | 4.0 μm |
| 23 | Toluene | Ethylene glycol monoisobutyl ether | 5/5 | 5/5 | 1.5 | Uniformly semitransparent | 2.1 μm | Uniformly semitransparent | 2.3 μm |
| 24 | Chlorobenzene | Ethylene glycol monoallyl ether | 6/4 | 7/3 | 1.5 | Uniformly semitransparent | 2.6 μm | Uniformly semitransparent | 2.8 μm |
| 25 | Cyclohexanone | Propylene glycol monomethyl ether | 6/4 | 6/4 | 1.5 | Uniformly semitransparent | 2.9 μm | Uniformly semitransparent | 3.0 μm |
| 26 | Cyclohexanone | Dipropylene glycol monomethyl ether | 5/5 | 5/5 | 1.5 | Uniformly semitransparent | 2.2 μm | Uniformly semitransparent | 2.3 μm |
| 27 | Cyclohexanone | Tripropylene glycol monomethyl ether | 7/3 | 6/4 | 1.5 | Uniformly semitransparent | 2.1 μm | Uniformly semitransparent | 2.3 μm |
| 28 | Ethylbenzene | Propylene glycol monobutyl ether | 9/1 | 4/6 | 1.5 | Uniformly bluish white color | 3.3 μm | Uniformly bluish white color | 3.5 μm |

TABLE 6-1

| Emulsion Production Example | Kinds and ratios of organic solvents: Hydrophobic organic solvent | Hydrophillic organic solvent | Hydrophobic/ hydrophillic | Water/ organic solvents | Amount of surfactant (mass %) | Evaluation for liquid stability: Immediately after preperation: Visual observation | Average particle diameter | After stirring after 2 weeks of standing: Visual observation | Average particle diameter |
|---|---|---|---|---|---|---|---|---|---|
| 29 | Chlorobenzene | Propylene glycol monomethyl ether acetate | 6/4 | 6/4 | 1.5 | Uniformly bluish white color | 4.4 μm | Uniformly bluish white color | 4.5 μm |
| 30 | Chloroform | Diethylene glycol methyl ethyl ether | 5/5 | 8/2 | 1.5 | Uniformly bluish white color | 4.3 μm | Uniformly bluish white color | 4.4 μm |
| 31 | o-Dichlorobenzene | Diethylene glycol diethyl ether | 7/3 | 6/4 | 1.5 | Uniformly bluish white color | 4.5 μm | Uniformly bluish white color | 4.7 μm |
| 32 | Toluene | Dipropylene glycol dimethyl ether | 6/4 | 7/3 | 1.5 | Uniformly bluish white color | 4.1 μm | Uniformly bluish white color | 4.4 μm |
| 33 | Toluene | Propylene glycol diacetate | 5/5 | 6/4 | 1.5 | Uniformly bluish white color | 3.1 μm | Uniformly bluish white color | 3.3 μm |
| 34 | 2-Heptanone | Methyl acetate | 2/8 | 6/4 | 1.5 | Uniformly bluish white color | 3.8 μm | Uniformly bluish white color | 3.9 μm |
| 35 | Cyclohexanone | Ethyl acetate | 2/8 | 6/4 | 1.5 | Uniformly bluish white color | 3.2 μm | Uniformly bluish white color | 3.3 μm |
| 36 | Cyclohexanone | n-Propyl alcohol | 7/3 | 6/4 | 1.5 | Uniformly bluish white color | 3.5 μm | Uniformly bluish white color | 3.7 μm |
| 37 | o-Xylene | 3-Methoxybutanol | 9/1 | 6/4 | 1.5 | Uniformly bluish white color | 4.8 μm | Uniformly bluish white color | 4.0 μm |
| 38 | Chloroform | 3-Methoxybutyl acetate | 5/5 | 6/4 | 1.5 | Uniformly bluish white color | 4.4 μm | Uniformly bluish white color | 4.6 μm |
| 39 | Chlorobenzene | Ethylene glycol monomethyl ether acetate | 6/4 | 7/3 | 1.5 | Uniformly bluish white color | 3.6 μm | Uniformly bluish white color | 3.7 μm |
| 40 | Chlorobenzene | Tetrahydrofuran | 5/5 | 5/5 | 1.5 | Uniformly semitransparent | 2.7 μm | Uniformly semitransparent | 2.8 μm |
| 41 | Cyclohexanone | Tetrahydrofuran | 5/5 | 6/4 | 1.5 | Uniformly semitransparent | 2.4 μm | Uniformly semitransparent | 2.7 μm |
| 42 | Cyclohexanone | Tetrahydrofuran | 6/4 | 7/3 | 1.5 | Uniformly semitransparent | 2.5 μm | Uniformly semitransparent | 2.7 μm |
| 43 | Cyclohexanone | Tetrahydrofuran | 7/3 | 4/3 | 1.5 | Uniformly bluish white color | 3.4 μm | Uniformly bluish white color | 3.6 μm |

TABLE 6-2

| Emulsion Production Example | Kinds and ratios of organic solvents: Hydrophobic organic solvent | Hydrophillic organic solvent | Hydrophobic/ hydrophillic | Water/ organic solvents | Amount of surfactant (mass %) | Evaluation for liquid stability: Immediately after preparation: Visual observation | Average particle diameter | After stirring after 2 weeks of standing: Visual observation | Average particle diameter |
|---|---|---|---|---|---|---|---|---|---|
| 44 | Toluene | Tetrahydrofuran | 5/5 | 6/4 | 1.5 | Uniformly semitransparent | 2.2 μm | Uniformly semitransparent | 2.4 μm |
| 45 | Chlorobenzene | 2-Butanone | 6/4 | 7/3 | 1.5 | Uniformly semitransparent | 2.8 μm | Uniformly semitransparent | 2.8 μm |
| 46 | o-Xylene | Tetrahydrofuran | 5/5 | 6/4 | 0 | Uniformly semitransparent | 2.7 μm | Uniformly semitransparent | 2.9 μm |
| 47 | Cyclohexanone | Dimethoxymethane | 6/4 | 7/3 | 0 | Uniformly bluish white color | 3.4 μm | Uniformly bluish white color | 3.6 μm |
| 48 | o-Dichlorobenzene | Tetrahydrofuran | 6/4 | 7/3 | 0 | Uniformly bluish white color | 3.6 μm | Uniformly bluish white color | 2.7 μm |
| 49 | Chloroform | Tetrahydrofuran | 5/5 | 6/4 | 0 | Uniformly semitransparent | 2.9 μm | Uniformly bluish white color | 3.2 μm |
| 50 | Ethylbenzene | Tetrahydrofuran | 5/5 | 6/4 | 0 | Uniformly bluish white color | 3.8 μm | Uniformly bluish white color | 4.1 μm |
| 51 | Cyclohexanone | Tetrahydrofuran | 7/3 | 7/3 | 1.5 | Uniformly transparent | 0.8 μm | Uniformly transparent | 0.5 μm |
| 52 | Toluene | Tetrahydrofuran | 5/5 | 6/4 | 1.5 | Uniformly transparent | 0.7 μm | Uniformly transparent | 0.7 μm |
| 53 | o-Xylene | Tetrahydrofuran | 6/4 | 7/3 | 1.5 | Uniformly transparent | 0.6 μm | Uniformly transparent | 0.9 μm |

According to the emulsion production examples, an emulsion containing an electron transporting substance can be prepared. In particular, an emulsion stably maintaining its emulsified state even in a long-term storage state and showing a small change as compared to its initial state is obtained by a method involving: preparing a solution by using solvents containing both a hydrophobic solvent and a hydrophilic solvent; and dispersing the solution in water to prepare the emulsion.

According to the method, the content of an organic solvent (a halogen-based solvent or an aromatic solvent) having a high solubility for the electron transporting substance in the emulsion can be reduced, and the emulsion has good long-term liquid stability, and hence the emulsion is useful as an application liquid for an undercoat layer.

Example 1

An aluminum cylinder having a diameter of 30 mm and a length of 260.5 mm was used as a support (conductive support).

Next, 10 parts of $SnO_2$ coating-treated barium sulfate (conductive particles), 2 parts of titanium oxide (pigment for resistance regulation), 6 parts of a phenol resin, 0.001 part of a silicone oil (leveling agent), and a mixed solvent of 4 parts of methanol and 16 parts of methoxypropanol were used to prepare an application liquid for a conductive layer. The application liquid for a conductive layer was applied onto the support by dip coating to form a coat, and the resultant coat was heated (thermally cured) at 140° C. for 30 minutes to form a conductive layer having a thickness of 15 μm.

Next, the emulsion produced in Emulsion Production Example 1 was applied onto the conductive layer by dip coating to form a coat. The step of heating the resultant coat at 165° C. for 1 hour was performed to form an undercoat layer having a thickness of 2.0 μm. Table 7 shows the emulsion used (Emulsion Production Example) and the conditions under which the coat of the emulsion was heated. It should be noted that the emulsion is an emulsion subjected to the following treatment: the emulsion was left at rest for 2 weeks (under a temperature of 23° C. and a humidity of 50%), and was then stirred with a homogenizer at 1,000 rotations/min for 3 minutes. The coat was formed by using the emulsion through the dip coating.

Next, 10 parts of a hydroxygallium phthalocyanine crystal (having intense peaks at Bragg angles)(20±0.2° of 7.5°, 9.9°, 16.3°, 18.6°, 25.1°, and 28.3° in CuKα characteristic X-ray diffraction) were prepared and then mixed with 250 parts of cyclohexanone and 5 parts of an acetal resin (trade name: S-LEC BX-1, manufactured by SEKISUI CHEMICAL CO., LTD.). The resultant mixture was dispersed by a sand mill apparatus using glass beads each having a diameter of 1 mm under a 23±3° C. atmosphere for 1 hour. After the dispersion, 250 parts of ethyl acetate were added to prepare an application liquid for a charge generating layer. The application liquid for a charge generating layer was applied onto the undercoat layer by dip coating to form a coat, and the resultant coat was dried at 100° C. for 10 minutes to form a charge generating layer having a thickness of 0.26 μm.

Next, 8 parts of an amine compound (hole transporting substance) represented by the following formula (8) and 10 parts of a polyester resin (having a structural unit represented by the following formula (9-1) and a structural unit represented by the following formula (9-2) at a ratio of 5/5, and having a weight-average molecular weight (Mw) of 100,000) were dissolved in a mixed solvent of 40 parts of dimethoxymethane and 60 parts of o-xylene to prepare an application liquid for a hole transporting layer. The application liquid for a hole transporting layer was applied onto the charge generating layer by dip coating to form a coat, and the resultant coat was dried at 120° C. for 40 minutes to form a hole transporting layer having a thickness of 15 μm. Thus, an electrophotographic photosensitive member was obtained.

(8)

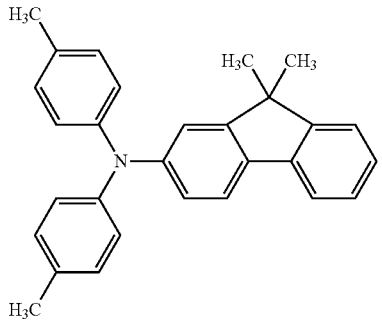

(9-1)

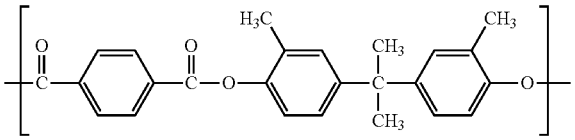

(9-2)

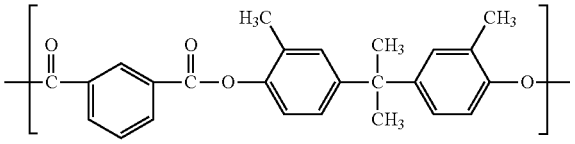

Next, an evaluation is described.

<Evaluation for Uniformity of Surface of Undercoat Layer>

Aside from above electrophotographic photosensitive member, the emulsion produced in Emulsion Production Example 1 was applied onto an aluminum cylinder having a diameter of 30 mm and a length of 260.5 mm by dip coating to form a coat. The resultant coat was heated at 165° C. for 1 hour to form an undercoat layer having a thickness of 2.0 μm.

The surface of the resultant undercoat layer at the position distant from the upper end portion in the longitudinal direction of the aluminum cylinder by 130 mm was measured for its surface roughness with a surface roughness measuring device (Surfcorder SE-3400, manufactured by Kosaka Laboratory Ltd.). The measurement of the surface roughness was an evaluation (evaluation length: 10 mm) performed based on a ten-point average roughness (Rzjis) evaluation in JIS B 0601:2001. Table 7 shows the result.

<Image Evaluation>

An image evaluation was performed by using the produced electrophotographic photosensitive member in a laser beam printer LBP-2510 manufactured by Canon Inc. In the image evaluation, for the charging potential (dark potential) of the electrophotographic photosensitive member and the exposure value (image exposure value) of a 780-nm laser light source, reconstruction was performed so that a light quantity on the surface of the electrophotographic photosensitive member became 0.3 μJ/cm$^2$. In addition, the evaluation was performed under an environment having a temperature of 23° C. and a relative humidity of 50%. The image evaluation was performed as follows: a monochromatic halftone image was output on A4 size plain paper and the output image was visually evaluated by the following criteria. Rank A and Rank B were each defined as the level at which the effect of the present invention was obtained. Table 7 shows the result.

Rank A: An entirely uniform image is found.
Rank B: Slight image unevenness is found.
Rank C: Image unevenness is found.
Rank D: Conspicuous image unevenness is found.

Examples 2 to 50 and 54 to 56

Electrophotographic photosensitive members were each produced by the same method as that of Example 1 except that: an undercoat layer was formed by using an emulsion described in Table 7; and the conditions under which the coat of the emulsion was heated were changed as described in Table 7. The electrophotographic photosensitive members were evaluated by the same methods as those of Example 1. Table 7 shows the results.

Examples 51 to 53

Electrophotographic photosensitive members were each produced by the same method as that of Example 1 except that in the step of forming the undercoat layer, the emulsion was not left at rest for 2 weeks after its preparation, and the emulsion was applied onto the conductive layer by dip coating within 1 hour after the preparation of the emulsion to form a coat, and the coat was heated. The electrophotographic photosensitive members were evaluated by the same methods as those of Example 1. Table 7 shows the results.

Examples 57 to 59

Electrophotographic photosensitive members were each produced by the same method as that of Example 1 except that in the step of forming the undercoat layer, the thickness of the coat after its heating was set to 1.0 μm. The electrophotographic photosensitive members were evaluated by the same methods as those of Example 1. Table 7 shows the results.

Comparative Example 1

An electrophotographic photosensitive member was produced and evaluated by the same methods as those of Example 1 except that its undercoat layer was formed as described below. Table 8 shows the results.

5 Parts of the compound represented by the formula (A-1) and 5 parts of the resin (D1) were dissolved in 30 parts of tetrahydrofuran to prepare a solution. Next, 3 parts of a surfactant (NOIGEN EA-167) were added to 57 parts of ion-exchanged water (conductivity: 0.2 μS/cm), and parts of the solution were gradually added to the mixture over 10 minutes while the mixture was stirred with a homogenizer at 3,000 rotations, thereby preparing an application liquid for an undercoat layer (100 parts). Further, the liquid was stirred for 20 minutes while the number of rotations was increased to 7,000 rotations. Thus, an application liquid for an undercoat layer (Application Liquid Production Example 1, 100 parts) was obtained.

The resultant application liquid for an undercoat layer was evaluated for its liquid stability by the same method as that of Emulsion Production Example 1. When the application liquid was visually observed immediately after the preparation of the application liquid, its color was an opaque white color. The average particle diameter of each of the oil droplets at the highest peak was 35.6 μm. However, several kinds of peaks were observed and the particle diameters of the oil droplets were nonuniform. Further, after the application liquid had been left at rest for 2 weeks, the application liquid separated and hence the particle diameter measurement could not be performed.

An undercoat layer was formed by the same method as that of Example 1 except that in the step of forming the undercoat layer, the application liquid was not left at rest for 2 weeks after its preparation, and the application liquid was applied onto the conductive layer by dip coating within 1 hour after the preparation of the application liquid to form a coat.

Comparative Example 2

An electrophotographic photosensitive member was produced and evaluated by the same methods as those of Example 1 except that its undercoat layer was formed as described below. Table 8 shows the results.

Application Liquid Production Example 2 was prepared by changing the organic solvent of Application Liquid Production Example 1 described in Comparative Example 1 from 30 parts of tetrahydrofuran to 30 parts of 2-butanone.

The resultant application liquid for an undercoat layer was evaluated for its liquid stability by the same method as that of Emulsion Production Example 1. When the application liquid was visually observed immediately after the preparation of the application liquid, its color was an opaque white color. The average particle diameter of each of the oil droplets at the highest peak was 32.1 μm. However, several kinds of peaks were observed and the particle diameters of the oil droplets were nonuniform. Further, after the application liquid had been left at rest for 2 weeks, the application liquid separated and hence the particle diameter measurement could not be performed.

An undercoat layer was formed by the same method as that of Example 1 except that in the step of forming the undercoat layer, the application liquid was not left at rest for 2 weeks after its preparation, and the application liquid was applied onto the conductive layer by dip coating within 1 hour after the preparation of the application liquid to form a coat.

Comparative Example 3

An electrophotographic photosensitive member was produced and evaluated by the same methods as those of Example 1 except that its undercoat layer was formed as described below. Table 8 shows the results.

Application Liquid Production Example 3 was prepared by changing the organic solvent of Application Liquid Production Example 1 described in Comparative Example 1 from 30 parts of tetrahydrofuran to 15 parts of 2-pentanone and 15 parts of tetrahydrofuran.

The resultant application liquid for an undercoat layer was evaluated for its liquid stability by the same method as that of Emulsion Production Example 1. When the application liquid was visually observed immediately after the preparation of the application liquid, its color was an opaque white color. The average particle diameter of each of the oil droplets at the highest peak was 22.4 μm. However, several kinds of peaks were observed and the particle diameters of the oil droplets were nonuniform. Further, after the application liquid had been left at rest for 2 weeks, the application liquid separated and hence the particle diameter measurement of the oil droplets could not be performed.

An undercoat layer was formed by the same method as that of Example 1 except that in the step of forming the undercoat layer, the application liquid was not left at rest for 2 weeks after its preparation, and the application liquid was applied onto the conductive layer by dip coating within 1 hour after the preparation of the application liquid to form a coat.

Comparative Example 4

An electrophotographic photosensitive member was produced and evaluated by the same methods as those of Example 1 except that its undercoat layer was formed as described below. Table 8 shows the results.

Application Liquid Production Example 4 was prepared by changing the organic solvent of Application Liquid Production Example 1 described in Comparative Example 1 from 30 parts of tetrahydrofuran to 15 parts of an oxalic acid ester (whose solubility in water at 25° C. and 1 atmosphere is 3.6 mass %) and 15 parts of tetrahydrofuran.

The resultant application liquid for an undercoat layer was evaluated for its liquid stability by the same method as that of Emulsion Production Example 1. When the application liquid was visually observed immediately after the preparation of the application liquid, its color was an opaque white color. The average particle diameter of each of the oil droplets at the highest peak was 20.5 μm. However, several kinds of peaks were observed and the particle diameters of the oil droplets were nonuniform. Further, after the application liquid had been left at rest for 2 weeks, the application liquid separated and hence the particle diameter measurement could not be performed.

An undercoat layer was formed by the same method as that of Example 1 except that in the step of forming the undercoat layer, the application liquid was not left at rest for 2 weeks after its preparation, and the application liquid was applied onto the conductive layer by dip coating within 1 hour after the preparation of the application liquid to form a coat.

Comparative Example 5

An electrophotographic photosensitive member was produced and evaluated by the same methods as those of Example 1 except that its undercoat layer was formed as described below. Table 8 shows the results.

An application liquid for an undercoat layer containing an electron transporting substance was prepared by the following method.

5 Parts of the compound represented by the formula (A-3) as the electron transporting substance, 2 parts of the resin (D1), 3 parts of a compound represented by the formula (B1:H1) as a crosslinking agent, and 0.03 part of dioctyltin dilaurate were dissolved in 30 parts of tetrahydrofuran to prepare a solution for an undercoat layer. Next, 3 parts of a surfactant (NOIGEN EA-167) were added to 57 parts of ion-exchanged water (conductivity: 0.2 μS/cm), and 40 parts of the solution were gradually added to the mixture over 10 minutes while the mixture was stirred with a homogenizer at 3,000 rotations, thereby preparing an application liquid for an undercoat layer (100 parts). Further, the liquid was stirred for 20 minutes while the number of rotations was increased to 7,000 rotations. Thus, an application liquid for an undercoat layer (Application Liquid Production Example 5, 100 parts) was obtained.

The resultant application liquid for an undercoat layer was evaluated for its liquid stability by the same method as that of Emulsion Production Example 1. When the application liquid was visually observed immediately after the preparation of the application liquid, its color was an opaque white color. The average particle diameter of each of the oil droplets at the highest peak was 38.4 μm. However, several kinds of peaks were observed and the particle diameters of the oil droplets were nonuniform. Further, after the application liquid had been left at rest for 2 weeks, the application liquid separated and hence the particle diameter measurement of the oil droplets could not be performed.

An undercoat layer was formed by the same method as that of Example 1 except that in the step of forming the undercoat layer, the application liquid was not left at rest for 2 weeks after its preparation, and the application liquid was applied onto the conductive layer by dip coating within 1 hour after the preparation of the application liquid to form a coat.

Comparative Example 6

An electrophotographic photosensitive member was produced and evaluated by the same methods as those of Example 1 except that its undercoat layer was formed as described below. Table 8 shows the results.

Application Liquid Production Example 6 was prepared by changing the organic solvent of Application Liquid Production Example 5 described in Comparative Example 5 from 30 parts of tetrahydrofuran to 15 parts of an oxalic acid ester and 15 parts of tetrahydrofuran.

The resultant application liquid for an undercoat layer was evaluated for its liquid stability by the same method as that of Emulsion Production Example 1. When the application liquid was visually observed immediately after the preparation of the application liquid, its color was an opaque white color. The average particle diameter of each of the oil droplets at the highest peak was 22.2 μm. However, several kinds of peaks were observed and the particle diameters of the oil droplets were nonuniform. Further, after the application liquid had been left at rest for 2 weeks, the application liquid separated and hence the particle diameter measurement of the oil droplets could not be performed.

An undercoat layer was formed by the same method as that of Example 1 except that in the step of forming the undercoat layer, the application liquid was not left at rest for 2 weeks after its preparation, and the application liquid was applied onto the conductive layer by dip coating within 1 hour after the preparation of the application liquid to form a coat.

TABLE 7

| Example | Emulsion Production Example | Heating condition: Heating temperature | Heating condition: Heating time | Evaluation for uniformity of thickness | Image evaluation |
|---|---|---|---|---|---|
| 1 | 1 | 165° C. | 60 minutes | 0.58 μm | C |
| 2 | 2 | 165° C. | 60 minutes | 0.68 μm | C |
| 3 | 3 | 165° C. | 60 minutes | 0.66 μm | C |
| 4 | 4 | 185° C. | 60 minutes | 0.15 μm | A |
| 5 | 5 | 185° C. | 60 minutes | 0.07 μm | A |
| 6 | 6 | 185° C. | 60 minutes | 0.11 μm | A |
| 7 | 7 | 160° C. | 60 minutes | 0.33 μm | B |
| 8 | 8 | 160° C. | 60 minutes | 0.27 μm | B |
| 9 | 9 | 160° C. | 60 minutes | 0.33 μm | B |
| 10 | 10 | 160° C. | 60 minutes | 0.37 μm | B |
| 11 | 11 | 160° C. | 60 minutes | 0.28 μm | B |
| 12 | 12 | 160° C. | 60 minutes | 0.28 μm | B |
| 13 | 13 | 160° C. | 60 minutes | 0.37 μm | B |
| 14 | 14 | 160° C. | 60 minutes | 0.41 μm | B |
| 15 | 15 | 160° C. | 60 minutes | 0.46 μm | B |
| 16 | 16 | 160° C. | 60 minutes | 0.47 μm | B |
| 17 | 17 | 160° C. | 60 minutes | 0.22 μm | B |
| 18 | 18 | 160° C. | 60 minutes | 0.30 μm | B |
| 19 | 19 | 160° C. | 60 minutes | 0.27 μm | B |
| 20 | 20 | 160° C. | 60 minutes | 0.45 μm | B |
| 21 | 21 | 160° C. | 60 minutes | 0.35 μm | B |
| 22 | 22 | 160° C. | 60 minutes | 0.24 μm | B |
| 23 | 23 | 160° C. | 60 minutes | 0.30 μm | B |
| 24 | 24 | 160° C. | 60 minutes | 0.40 μm | B |
| 25 | 25 | 160° C. | 60 minutes | 0.25 μm | B |
| 26 | 26 | 160° C. | 60 minutes | 0.33 μm | B |
| 27 | 27 | 160° C. | 60 minutes | 0.27 μm | B |
| 28 | 28 | 160° C. | 60 minutes | 0.37 μm | B |
| 29 | 29 | 160° C. | 60 minutes | 0.39 μm | B |
| 30 | 30 | 160° C. | 60 minutes | 0.30 μm | B |
| 31 | 31 | 160° C. | 60 minutes | 0.29 μm | B |
| 32 | 32 | 160° C. | 60 minutes | 0.38 μm | B |
| 33 | 33 | 160° C. | 60 minutes | 0.43 μm | B |
| 34 | 34 | 160° C. | 60 minutes | 0.31 μm | B |
| 35 | 35 | 160° C. | 60 minutes | 0.45 μm | B |
| 36 | 36 | 160° C. | 60 minutes | 0.40 μm | B |
| 37 | 37 | 160° C. | 40 minutes | 0.45 μm | B |
| 38 | 38 | 160° C. | 90 minutes | 0.37 μm | B |
| 39 | 39 | 160° C. | 60 minutes | 0.32 μm | B |
| 40 | 40 | 160° C. | 60 minutes | 0.18 μm | A |
| 41 | 41 | 160° C. | 60 minutes | 0.04 μm | A |
| 42 | 42 | 160° C. | 60 minutes | 0.06 μm | A |
| 43 | 43 | 160° C. | 60 minutes | 0.16 μm | A |
| 44 | 44 | 160° C. | 40 minutes | 0.11 μm | A |
| 45 | 45 | 160° C. | 60 minutes | 0.07 μm | A |
| 46 | 46 | 165° C. | 60 minutes | 0.23 μm | B |
| 47 | 47 | 185° C. | 60 minutes | 0.46 μm | B |
| 48 | 48 | 160° C. | 60 minutes | 0.12 μm | A |
| 49 | 49 | 160° C. | 60 minutes | 0.35 μm | B |
| 50 | 50 | 160° C. | 60 minutes | 0.37 μm | B |
| 51 | 1 | 165° C. | 60 minutes | 0.45 μm | B |
| 52 | 2 | 165° C. | 60 minutes | 0.42 μm | B |
| 53 | 3 | 165° C. | 60 minutes | 0.37 μm | B |
| 54 | 51 | 160° C. | 60 minutes | 0.10 μm | A |
| 55 | 52 | 160° C. | 60 minutes | 0.08 μm | A |
| 56 | 53 | 160° C. | 60 minutes | 0.05 μm | A |
| 57 | 51 | 160° C. | 60 minutes | 0.11 μm | A |
| 58 | 52 | 160° C. | 60 minutes | 0.06 μm | A |
| 59 | 53 | 160° C. | 60 minutes | 0.06 μm | A |

TABLE 8

| Comparative Example | Application Liquid Production Example | Heating condition: Heating temperature | Heating condition: Heating time | Evaluation for uniformity of thickness | Image evaluation |
|---|---|---|---|---|---|
| 1 | 1 | 165° C. | 60 minutes | 1.57 μm | D |
| 2 | 2 | 165° C. | 60 minutes | 0.92 μm | D |
| 3 | 3 | 165° C. | 60 minutes | 0.96 μm | D |
| 4 | 4 | 165° C. | 60 minutes | 0.88 μm | D |
| 5 | 5 | 160° C. | 60 minutes | 1.22 μm | D |
| 6 | 6 | 160° C. | 60 minutes | 0.86 μm | D |

Comparison between Examples and Comparative Examples 1 to 6 shows that an electrophotographic photosensitive member obtained by forming a coat through the use of the emulsion of the present invention and heating the coat to form an undercoat layer provides a good image output. When only a liquid whose solubility in water exceeds 3.0 mass % is used as a solvent, the particle diameters of oil droplets are large and multiple particle diameter peaks are observed from a time point immediately after the preparation of an application liquid. Accordingly, the particle diameters are found to be nonuniform. Even when the application liquid of each of Comparative Examples 1 to 6 is formed into a coat without being left at rest and the coat is heated to form an undercoat layer, the uniformity of the undercoat layer is low and image unevenness is remarkably observed. This is probably because the agglomeration of the oil droplets of the application liquid occurs owing to the coalescence of the oil droplets to impair the uniformity of the oil droplets in the emulsion, and hence the uniformity of the surface of the undercoat layer reduces.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-128288, filed Jun. 19, 2013, and Japanese Patent Application No. 2014-119359, filed Jun. 10, 2014, which are hereby incorporated by reference herein in their entirety.

What is claimed is:

1. A process for producing an electrophotographic photosensitive member including a support, an undercoat layer formed on the support, a charge generating layer formed on the undercoat layer, and a hole transporting layer formed on the charge generating layer, the process comprising:

preparing a solution containing:

a liquid whose solubility in water at 25° C. and 1 atmosphere is 3.0 mass % or less, and an electron transporting substance;

preparing an emulsion by dispersing the solution in water;

forming a coat of the emulsion on the support; and forming the undercoat layer by heating the coat.

2. A process for producing an electrophotographic photosensitive member according to claim 1, wherein the solution further contains a liquid whose solubility in water at 25° C. and 1 atmosphere is 5.0 mass % or more.

3. A process for producing an electrophotographic photosensitive member according to claim 2, wherein the liquid whose solubility in water at 25° C. and 1 atmosphere is 5.0 mass % or more is at least one selected from the group consisting of tetrahydrofuran, dimethoxymethane, 2-butanone, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate.

4. A process for producing an electrophotographic photosensitive member according to claim 3, wherein the liquid whose solubility in water at 25° C. and 1 atmosphere is 5.0 mass % or more is at least one selected from the group consisting of tetrahydrofuran, 2-butanone, and methanol.

5. A process for producing an electrophotographic photosensitive member according to claim 2, wherein the solution further contains a resin.

6. A process for producing an electrophotographic photosensitive member according to claim 5, wherein:

the electron transporting substance is an electron transporting substance having a polymerizable functional group; and the solution further contains the resin having a polymerizable functional group and a crosslinking agent.

7. A process for producing an electrophotographic photosensitive member according to claim 2, wherein:

the electron transporting substance is an electron transporting substance having a polymerizable functional group; and the solution further contains a crosslinking agent.

8. A process for producing an electrophotographic photosensitive member according to claim 6, wherein a ratio (w/(a+b+r+ct+k)) of (w) to (a+b+r+ct+k) in the emulsion is 5/5 to 7/3 where "w" represents a mass of the water in the emulsion, "a" represents a mass of the liquid whose solubility in water at 25° C. and 1 atmosphere is 3.0 mass % or less in the emulsion, "b" represents a mass of the liquid whose solubility in water at 25° C. and 1 atmosphere is 5.0 mass % or more in the emulsion, "ct" represents a mass of the electron transporting substance in the emulsion, "r" represents a mass of the resin in the emulsion, and "k" represents a mass of the crosslinking agent in the emulsion.

9. A process for producing an electrophotographic photosensitive member according to claim 2, wherein a ratio (a/b) of (a) to (b) in the emulsion is 1/9 to 9/1 where "a" represents a mass of the liquid whose solubility in water at 25° C. and 1 atmosphere is 3.0 mass % or less in the emulsion, and "b" represents a mass of the liquid whose solubility in water at 25° C. and 1 atmosphere is 5.0 mass % or more in the emulsion.

10. A process for producing an electrophotographic photosensitive member according to claim 1, wherein the electron transporting substance is at least one selected from the group consisting of an imide compound, a quinone compound, and a benzimidazole compound.

11. A process for producing an electrophotographic photosensitive member according to claim 1, wherein the liquid whose solubility in water at 25° C. and 1 atmosphere is 3.0 mass % or less is at least one selected from the group consisting of cyclohexanone, toluene, and xylene.

* * * * *